US012454834B2

(12) United States Patent
Nilsson et al.

(10) Patent No.: US 12,454,834 B2
(45) Date of Patent: Oct. 28, 2025

(54) SET OF PANELS COMPRISING A LOCKING DEVICE

(71) Applicant: Välinge Innovation AB, Viken (SE)

(72) Inventors: Anders Nilsson, Helsingborg (SE); Fredrik Boo, Kågeröd (SE)

(73) Assignee: VÄLINGE INNOVATION AB, Viken (SE)

( * ) Notice: Subject to any disclaimer, the term of this patent is extended or adjusted under 35 U.S.C. 154(b) by 238 days.

(21) Appl. No.: 18/370,454

(22) Filed: Sep. 20, 2023

(65) Prior Publication Data

US 2024/0093509 A1 Mar. 21, 2024

(30) Foreign Application Priority Data

Sep. 21, 2022 (SE) ..... 2251093-7

(51) Int. Cl.
*E04F 15/02* (2006.01)

(52) U.S. Cl.
CPC *E04F 15/02038* (2013.01); *E04F 2201/0146* (2013.01); *E04F 2201/0535* (2013.01)

(58) Field of Classification Search
CPC ..... E04F 15/02038; E04F 2201/0146; E04F 2201/0535
See application file for complete search history.

(56) References Cited

U.S. PATENT DOCUMENTS 9,528,275 B2 * 12/2016 Cappelle ..... E04F 15/02
9,951,526 B2 * 4/2018 Boo ..... E04F 15/102
11,702,844 B2 * 7/2023 Svensson ..... F16B 5/0016 52/588.1
2007/0006543 A1 1/2007 Engstrom
(Continued)

FOREIGN PATENT DOCUMENTS

DE 102015106035 A1 2/2016
EP 2236694 A1 10/2010
(Continued)

OTHER PUBLICATIONS

U.S. Appl. No. 17/697,334, Fredrik Boo, filed Mar. 17, 2022.
(Continued)

*Primary Examiner* — Brent W Herring
(74) *Attorney, Agent, or Firm* — Boone IP Law

(57) ABSTRACT

The disclosure relates to a set of panels, such as building panels, comprising a first panel and a second panel and a locking device for locking a first edge portion of the first panel to a second edge portion of the second panel. The locking device includes a vertical locking device. The vertical locking device comprises a flexible tongue arranged in an insertion groove of one of said first edge portion and said second edge portion. The vertical locking device also comprises a tongue groove provided in and extending along the other of said one of said first edge portion and said second edge portion. In a vertically locked state of the first and second edge portions a flexible portion of the flexible tongue cooperates with tongue groove. In the vertically locked state of the first and second edge portions a longitudinal end portion of the flexible tongue cooperates with a stop surface on the other of said one of said first edge portion and said second edge portion.

15 Claims, 13 Drawing Sheets

(56) References Cited

U.S. PATENT DOCUMENTS

| | | | | |
|---|---|---|---|---|
| 2008/0236088 | A1* | 10/2008 | Hannig | F16B 5/0056 52/592.1 |
| 2011/0167750 | A1 | 7/2011 | Pervan | |
| 2012/0042598 | A1* | 2/2012 | Vermeulen | E04F 15/02038 52/588.1 |
| 2015/0300029 | A1* | 10/2015 | Pervan | E04F 15/02038 52/582.2 |
| 2018/0355619 | A1* | 12/2018 | Neuman | E04F 15/102 |
| 2025/0179811 | A1* | 6/2025 | Nilsson | E04F 13/0894 |

FOREIGN PATENT DOCUMENTS

| | | | |
|---|---|---|---|
| EP | 3702549 | A1 | 9/2020 |
| WO | 2010/108980 | A1 | 9/2010 |
| WO | 2014/081382 | A1 | 5/2015 |
| WO | 2021/246945 | A1 | 12/2021 |
| WO | 2022/197234 | A1 | 9/2022 |

OTHER PUBLICATIONS

U.S. Appl. No. 18/069,320, Lucas Larsson, filed Dec. 21, 2022.
U.S. Appl. No. 18/313,110, Darko Pervan, filed May 5, 2023.
U.S. Appl. No. 18/222,449, Christian Boo, filed Jul. 16, 2023.
U.S. Appl. No. 18/242,312, Roger Ylikangas, filed Sep. 5, 2023.
U.S. Appl. No. 18/370,443, Fredrik Boo, filed Sep. 20, 2023.
U.S. Appl. No. 19/174,449, Lucas Larsson, filed Apr. 9, 2025.
International Search Report and Written Opinion received for PCT Patent Application No. PCT/SE2023/050920, mailed on Oct. 23, 2023, 12 pages.
Office Action received for Swedish Patent Application No. 2251093-7, mailed on Mar. 23, 2023, 9 pages.
U.S. Appl. No. 19/014,541, Fredrik Boo, filed Jan. 9, 2025.
U.S. Appl. No. 18/963,840, Anders Nilsson, filed Nov. 19, 2024.
U.S. Appl. No. 18/635,607, Fredrik Boo, filed Apr. 15, 2024.
U.S. Appl. No. 19/221,907, Christian Boo, filed May 29, 2025.

* cited by examiner

SET OF PANELS COMPRISING A LOCKING DEVICE

CROSS REFERENCE TO RELATED PARAGRAPHS

The present application claims the benefit of Swedish application no. 2251093-7, filed on Sep. 21, 2022. The entire contents of Swedish application no. 2251093-7 are hereby incorporated herein by reference in their entirety.

TECHNICAL FIELD

The disclosure relates to a set of panels comprising a first panel, a second panel and a locking device.

BACKGROUND

Floating floor panels such as laminate floor panels are generally joined mechanically by means of mechanical locking systems. These systems comprise locking means, which lock the panels horizontally and vertically on all edges.

WO 2014/081382 A1 discloses a set of floor panels that are mechanically connectable to each other at a first and a second edge of a first and a second floor panel respectively, wherein upper edges of said first and second edge in a connected state define a vertical plane. The first edge is provided with a protruding tongue formed in one piece with the core of the first floor panel. Said protruding tongue extends beyond the vertical plane. The second edge is provided with a separate flexible tongue comprising an inner part, which is connected to a holding groove at the second edge, and an outer flexible snap tab that extends upwardly and in the connected state into a cavity under the protruding tongue for locking the first and the second floor panel to each other in a vertical direction.

The main advantages of floating floors with mechanical locking systems are that they are easy to install. Several versions of locking systems are used on the market and there is a continuous demand for improvements.

SUMMARY

One object of the disclosure is to alleviate, at least in part, drawbacks of the prior art. One object of the disclosure is to provide a set of panels having a locking device with a more facile disassembling or unlocking.

According to a first aspect of the disclosure, there is provided a set of panels, such as building panels, comprising a first panel and a second panel and a locking device for locking a first edge portion of the first panel to a second edge portion of the second panel. The panels comprise a front side and a rear side, a main plane extending along the front and/or the rear side, and a normal of the main plane. The normal defines a vertical direction. The locking device comprises a horizontal locking device and a vertical locking device. The vertical locking device comprises a flexible tongue arranged in an insertion groove of one of said first edge portion and said second edge portion. The flexible tongue extends along said one of said first edge portion and said second edge portion. The vertical locking device further comprises a tongue groove provided in, and extending along, the other (one) of said one of said first edge portion and said second edge portion. In a vertically locked state of the first and second edge portions a flexible portion of the flexible tongue cooperates with a locking surface in the tongue groove; and a longitudinal end portion of the flexible tongue cooperates with a stop surface on the other of said one of said first edge portion and said second edge portion. In the vertically locked state of the first and second edge portions, said stop surface is closer to a bottom of said insertion groove than said locking surface. The stop surface may impede the flexible portion, such as a tip of the flexible portion, from cooperation with the locking surface, and the flexible tongue from entering the tongue groove, at the end portion of the flexible tongue.

A tip of the longitudinal end portion may be closer to a bottom of said insertion groove than a tip of the flexible portion.

The stop surface may be essentially vertical, such as the inclination of the stop surface is 0-10° from the vertical axis Z, such as 0-5° from the vertical axis Z.

The stop surface may be provided adjacent to the tongue groove in the longitudinal direction.

The flexible tongue may be longer than the tongue groove. An end portion of the tongue groove may be beveled.

The stop surface may be part of a piece of a separate material, such as a polymer based material, a wood-based material, or a filler, preferably provided in the tongue groove.

The first edge portion of the first panel and the second edge portions of the second panel may be short edge portions.

A part, such as a tip, of the flexible portion may protrude from the insertion groove along most of the length of the flexible tongue in the vertically locked state.

A part, such as a tip, of the flexible portion may protrude from the insertion groove along 50-98%, such as 70-95%, such as 90-95% of the length of the flexible tongue in the vertically locked state.

A part, such as a tip, of the flexible portion may protrude from the insertion groove along at least 90%, such as at least 95% of the length of tongue groove, in the vertically locked state.

Stop surfaces may be provided on opposing sides of the tongue groove. Having stop surfaces on both (opposing) longitudinal sides of the tongue groove may enable a reversed disassembling of the laid panels, such as the laid floor. Sometimes it may be easier to start disassembling in the reversed order.

The flexible portion may be configured to be displaced towards a bottom surface of the insertion groove during assembling and may be configured to spring back towards the locking surface in the locked state.

The flexible portion may be a pivoting member, such as a pivoting tab.

The pivoting member may be biased by the stop surface in said vertically locked state. The spring force from the biased pivoting member may facilitate the unlocking of the second edge portion from the first edge portion.

The flexible tongue may comprise an inner portion configured to face the bottom of the insertion groove when arranged therein.

The flexible tongue may be arranged in an insertion groove in the first edge portion, said flexible tongue extending along said first edge portion. The tongue groove may be provided in and extending along the second edge portion. In the vertically locked state of the first and second edge portions, the longitudinal end portion of the flexible tongue may cooperate with a stop surface on the second edge portion.

The flexible tongue may be arranged in an insertion groove in the second edge portion, said flexible tongue extending along said second edge portion. The tongue groove may be provided in, and extending along, the first edge portion. In the vertically locked state of the first and second edge portions the longitudinal end portion of the flexible tongue cooperates with a stop surface on the first edge portion.

The horizontal locking device may comprise a locking element arranged on a strip extending horizontally outwards from a lower portion of the first edge portion and a locking groove provided in the second edge portion. The locking element and the locking groove may be configured to cooperate to provide a horizontally locked state of the first and the second edge portions.

The first and second edge portions may be configured to be vertically unlocked by a relative vertical displacement of the first and second edge portions away from each other and/or by a repeated relative vertical displacement of the first and second edge portions away from and towards each other.

There may be a shelf, which is preferably horizontal, between the joint seam, between the front side 1*c* of the first panel and the front side 2*c* of the second panel. Such shelf may give improved water resistance properties of the panels, in particular of the joint seams of the panels. The joint seam may be a small gap of 0.12 mm, such as 0.1-1 mm, such as 0.1-0.5 mm. The joint seam may have a vertical plane, although with a slight thickness depending on the thickness of the possible gap.

According to a second aspect of the disclosure, there is provided a set of panels, such as building panels, comprising a first panel and a second panel and a locking device for locking a first edge portion of the first panel to a second edge portion of the second panel. The panels comprise a front side and a rear side, a main plane extending along the front and/or the rear side, and a normal of the main plane. The normal defines a vertical direction. The locking device comprises a horizontal locking device and a vertical locking device. The vertical locking device comprises a flexible tongue arranged, such as inserted in, in an insertion groove of one of said first edge portion and said second edge portion, said flexible tongue extending along said one of said first edge portion and said second edge portion, and a tongue groove provided in, and extending along the other of said one of said first edge portion and said second edge portion.

In a vertically locked state of the first and second edge portions: a flexible portion of the flexible tongue cooperates with a locking surface in the tongue groove; and a longitudinal end portion of the flexible tongue comprises an abutment member. The abutment member cooperates with a stop surface on the other of said one of said first edge portion and said second edge portion, in a vertically locked state of the first and second edge portions. The stop surface is closer to a bottom of said insertion groove than said locking surface.

The stop surface may be essentially vertical, such as the inclination of the stop surface is 0-20° from the vertical axis Z, 0-10° from the vertical axis Z, such as 0-5° from the vertical axis Z.

The stop surface may be provided below the tongue groove.

The first edge portion of the first panel and the second edge portions of the second panel may be short edge portions.

A part of the flexible portion may protrude from the insertion groove along most of the length of the flexible tongue in the vertically locked state.

Abutment members may be provided on opposing longitudinal end portions of the flexible tongue. This may enable reversed disassembling.

The flexible portion may be a pivoting member.

The flexible tongue may comprise an inner portion configured to face the bottom of the insertion groove when arranged therein.

The flexible tongue may be arranged in an insertion groove in the first edge portion, said flexible tongue extending along said first edge portion; and the tongue groove may be provided in, and extending along, the second edge portion. In a vertically locked state of the first and second edge portions the abutment member of the flexible tongue may cooperate with a stop surface on the second edge portion.

The flexible tongue may be arranged in an insertion groove in the second edge portion, said flexible tongue extending along said second edge portion; and the tongue groove may be provided in, and extending along the first edge portion. In a vertically locked state of the first and second edge portions the abutment member of the flexible tongue may cooperate with a stop surface on the first edge portion.

The horizontal locking device may comprise a locking element arranged on a strip extending horizontally outwards from a lower portion of the first edge portion and a locking groove provided in the second edge portion. The locking element and the locking groove may be configured to cooperate to provide a horizontally locked state of the first and the second edge portions.

The first and second edge portions may be configured to be vertically unlocked by a relative vertical displacement of the first and second edge portions away from each other and/or by a repeated relative vertical displacement of the first and second edge portions away from and towards each other.

There may be a shelf, which is preferably horizontal, between the joint seam, between the front side of the first panel and the front side of the second panel, and the tongue groove or the insertion groove.

In a third aspect of the disclosure, there is provided a set of panels, such as building panels, comprising a first panel and a second panel and a locking device for locking a first edge portion of the first panel to a second edge portion of the second panel. The panels comprise a front side and a rear side, a main plane extending along the front and/or the rear side, and a normal of the main plane. The normal defines a vertical direction. The locking device comprises a horizontal locking device and a vertical locking device. The vertical locking device comprises a flexible tongue arranged in an insertion groove of one of said first edge portion and said second edge portion. The flexible tongue extends along said one of said first edge portion and said second edge portion. The vertical locking device further comprises a tongue groove provided in and extending along the other of said one of said first edge portion and said second edge portion. In a vertically locked state of the first and second edge portions a flexible portion of the flexible tongue cooperates with a locking surface in the tongue groove. In a vertically locked state of the first and second edge portions a longitudinal end portion of the flexible portion is beveled such that the vertical locking is gradually reduced, such as reduced to no vertical locking, towards the end of the longitudinal end portion.

The first edge portion of the first panel and the second edge portions of the second panel may be short edge portions.

A part of the flexible portion may protrude from the insertion groove along most of the length of the flexible tongue in the vertically locked state.

The longitudinal end portions may both be beveled.

The flexible portion may be a pivoting member.

The flexible tongue may comprise an inner portion configured to face the bottom of the insertion groove when arranged therein.

The flexible tongue may be arranged in an insertion groove in the first edge portion, said flexible tongue extending along said first edge portion; and the tongue groove may be provided in, and extending along, the second edge portion.

The flexible tongue may be arranged in an insertion groove in the second edge portion, said flexible tongue extending along said second edge portion; and the tongue groove may be provided in, and extending along, the first edge portion.

The horizontal locking device may comprise a locking element arranged on a strip extending horizontally outwards from a lower portion of the first edge portion and a locking groove provided in the second edge portion. The locking element and the locking groove may be configured to cooperate to provide a horizontally locked state of the first and the second edge portions.

The first and second edge portions may be configured to be vertically unlocked by a relative vertical displacement of the first and second edge portions away from each other and/or by a repeated relative vertical displacement of the first and second edge portions away from and towards each other.

There may be a shelf, which is preferably horizontal, between the joint seam, between the front side of the first panel and the front side of the second panel, and the tongue groove or the insertion groove.

BRIEF DESCRIPTION OF THE DRAWINGS

The disclosure will in the following be described in connection to exemplary embodiments and in greater detail with reference to the appended exemplary drawings, wherein.

DETAILED DESCRIPTION

Next, various embodiments of the disclosure will be described with reference to the embodiments in, e.g., FIGS. 1-13A.

Figure 1A:
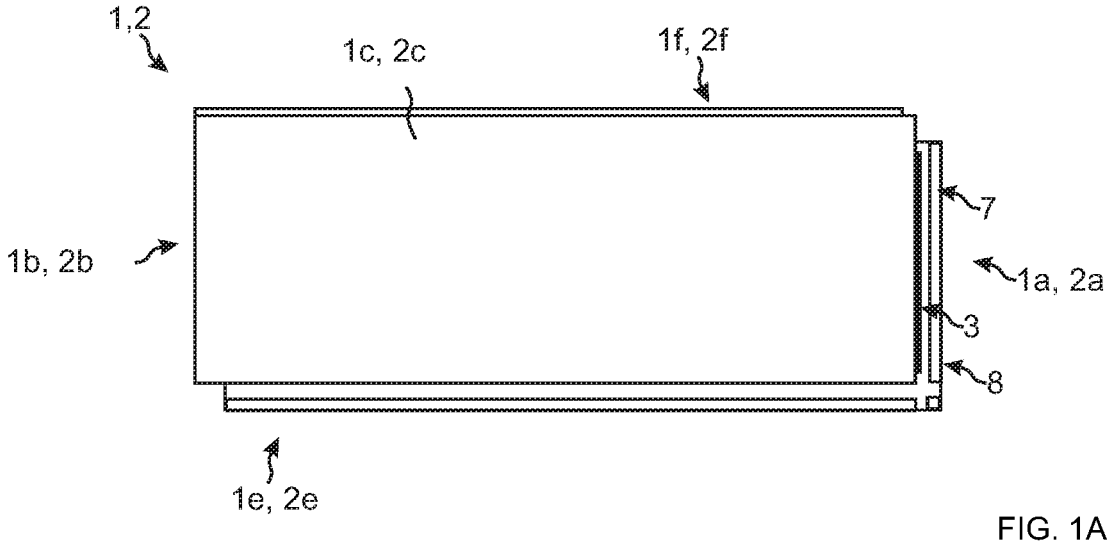
FIG. 1A illustrates in a top view an embodiment of a panel.
Figure 1B:
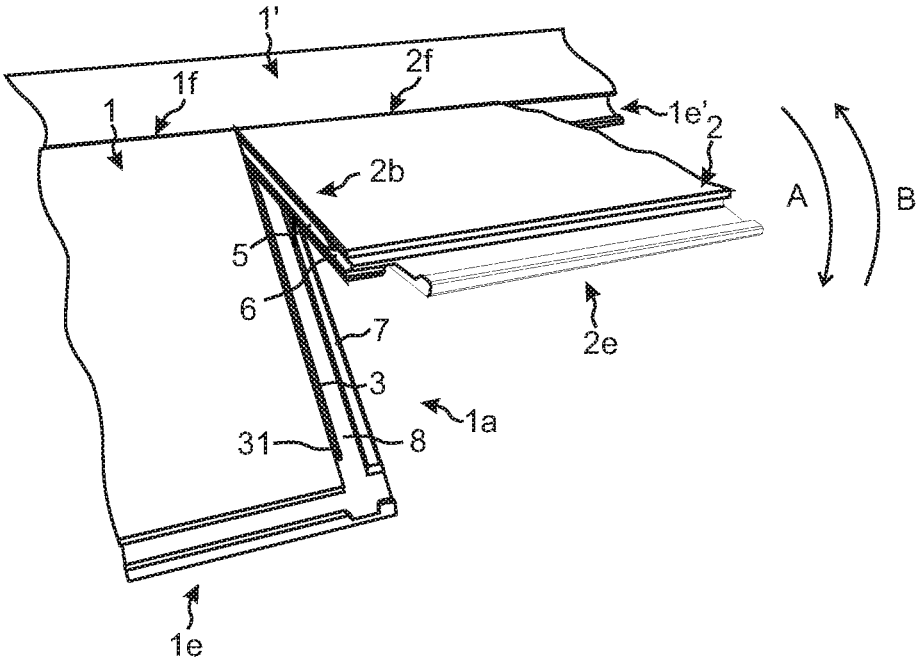
FIG. 1B illustrates in a perspective view an embodiment of panels during assembling or disassembling.

With reference to FIGS. 1A and 1B, the disclosure relates to a set of panels, such as building panels, comprising a first 1 and a second 2 panel comprising a first 1*a* and a second 2*b* edge portion, respectively. With reference to FIGS. 2B and 2C, the panels 1, 2 comprise a front side 1*c*, 2*c* and a rear side 1*d*, 2*d*, preferably extending along a first X and a second Y perpendicular horizontal direction. A normal N of a main plane MP1, MP2 extending along the front and/or the rear side defines a vertical direction Z.

The panels 1, 2 herein may be rectangular. Preferably, the first 1*a* and second 2*b* edge portions, where the locking device is provided, are short edge portions. The panels 1, 2 may comprise opposing short edge portions 1*a*, 2*a* and 1*b*, 2*b* as shown in, e.g., FIG. 1A. The panels 1, 2 may further comprise third 1*f*, 2*f* and fourth 1*e*, 2*e* opposing edge portions, which preferably are long edge portions, as shown in FIG. 1A.

The third edge portion 1*f*, 2*f* and the fourth edge portion 1*e*, 2*e* may have horizontal locking devices which may be locked and unlocked by an angling motion A, B, respectively (FIG. 1B). The same angling motions A, B may be vertical displacements A, B of the first edge portion 1*a* relative the second edge portion 2*b*.

In some embodiments, however, the opposing edge portions 1*a*, 2*a* and 1*b*, 2*b* may be long edge portions and the opposing edge portions 1*e*, 2*e* and 1*f*, 2*f* may be short edge portions.

The set of panels further comprises a locking device for locking the first edge portion 1*a* and the second edge 2*b* portion to each other and obtaining a locked state of the set of panels. The locking device comprises a horizontal locking device and a vertical locking device configured to define a horizontally and vertically locked state of the first 1*a* and second 2*b* edge portions, respectively.

Figure 2A:
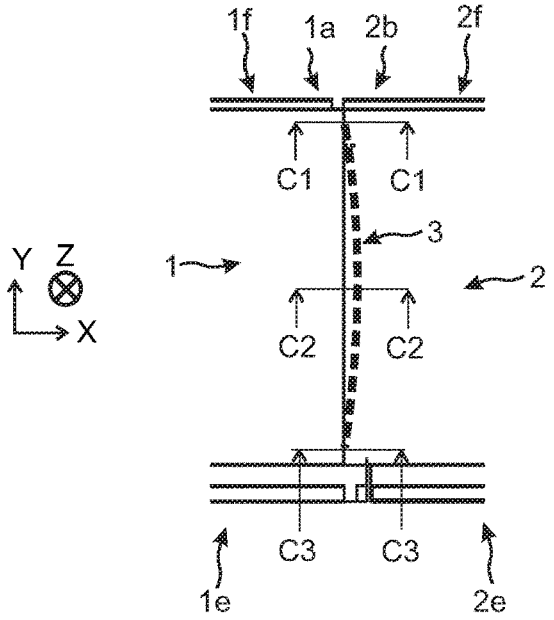
FIG. 2A shows a top view of an embodiment of two assembled panels and indicates the positions of crosscut views C1-C1, C2-C2 and C3-C3.
Figure 2B:
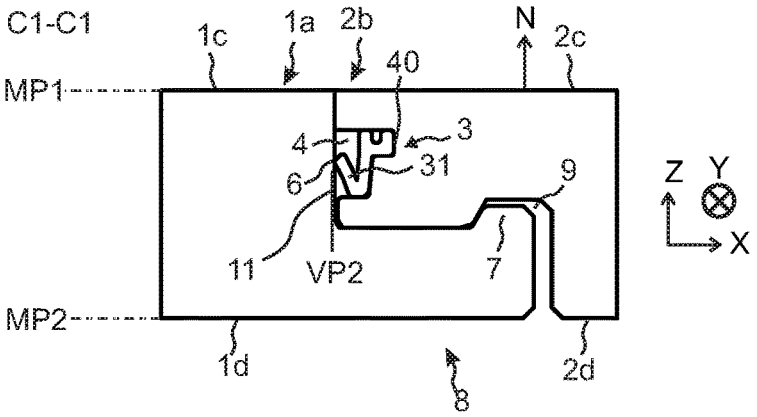
FIGS. 2B-C show an embodiment of the two assembled panels in crosscut views C1-C1 and C2-C2, respectively.
Figure 2C:
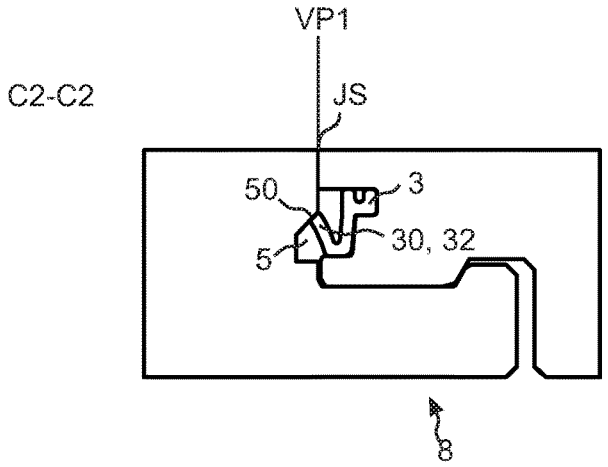

FIG. 2A shows a top view of a first edge portion 1*a* of a first panel locked with a second edge portion 2*b* of a second panel. FIG. 2A defines schematically where the cross-sectional views C1-C1, C2-C2 and C3-C3 are along the first edge portion 1*a* locked to the second edge portion 2*b*. These cross-sectional views are found throughout the detailed description to show embodiments of the locking device according to the disclosure, e.g., FIGS. 2B, 2C, 3A, 3B, 3C, 5A, 5B, 5D, 7B, 8A-8F, 8C, 10B AND 10C.

According to a first aspect of the disclosure, and with reference to, e.g., FIGS. 2B, 2C, 3A-C, 5A-D, 7A and 7B, the vertical locking device comprises a flexible tongue 3 arranged in an insertion groove 4 of one of said first edge portion 1*a* and said second edge portion 2*b*. The flexible tongue 3 may in other words be inserted in the insertion groove 4. The insertion groove 4 may in other words house at least a portion of the flexible tongue 3. The flexible tongue 3 may be a separate entity which may be attached in the insertion groove 4. The flexible tongue 3 extends along the same one of said first edge portion 1*a* and said second edge portion 2*b*.

The flexible tongue 3 may be separate and may be polymer based, such as thermoplastic based. The flexible tongue 3 may be extruded or produced by injection moulding, such as extruded.

The vertical locking device also comprises a tongue groove 5 provided in and extending along the other one of said first edge portion 1*a* and said second edge portion 2*b*.

Thus, the flexible tongue 3 in the insertion groove 4 may be provided on either panel, i.e., on the first edge portion 1*a* or the second edge portion 2*b*. Accordingly, the tongue groove 5 may be provided in, and extending along, the other one of the first edge portion 1*a* and second edge portion 2*b*, such that the flexible tongue 3 may cooperate, such as engage, with the tongue groove 5.

With reference to, e.g., FIGS. 2B, 2C, 3A-D, 5A-D, 7A and 7B, in a vertically locked state of the first 1*a* and second 2*b* edge portions, a flexible portion 30 of the flexible tongue 3 cooperates with a locking surface 50 in the tongue groove 5.

The flexible portion 30 may cooperate with the locking surface 50 at a locking surface portion 63.

The flexible tongue 3 may comprise a longitudinal end portion 31 and an opposite longitudinal end portion 37, wherein the flexible portion 30 may extend between the longitudinal end portion 31 and the opposite longitudinal end portion 37.

The longitudinal end portion 31 of the flexible tongue 3 cooperates, such as engages, with a stop surface 6 on the other of said one of said first edge portion 1*a* and said second edge portion 2*b*. The stop surface 6 may be closer to a bottom 40 of said insertion groove 4 than said locking surface 50.

The longitudinal end portion 31 and/or the opposite longitudinal end portion 37 may cooperate with the stop surface 6 at a stop surface zone 64.

The locking surface 50 may be positioned at a first distance 61 from the bottom 40 of the insertion groove 4.

The stop surface 6 may be positioned at a second distance 62 from the bottom 40 of the insertion groove 4.

The first distance 61 and the second distance 62 may be measured in a horizontal direction X.

The first distance 61 may be measured from the locking surface portion 63.

The second distance 62 may be measured from the stop surface zone 64.

An outer tip of the longitudinal end portion 31 and/or the opposite longitudinal end portion 37 may be closer to a bottom 40 of said insertion groove 4 than an outer tip of the flexible portion 30.

A vertical displacement end, such as the folding end of the panel may be the third 1*f*, 2*f* or the fourth 1*e*, 2*e* edge portion.

The stop surface 6 may be adjacent the tongue groove 5 on the end of the tongue groove closer to the vertical displacement end. The longitudinal end portion 31 may be oriented towards the vertical displacement end. The vertical displacement end may be the fourth edge portion 1*e*, 2*e* (see FIG. 1B).

The stop surface 6 may be adjacent the tongue groove 5 on the end of the tongue groove closer to the fourth edge portion 1*e*. The longitudinal end portion 31 may be located on the end of the flexible tongue 3 closer to the fourth edge portion 1*e*.

The flexible tongue 3 may be arranged in an insertion groove 4 in the first edge portion 1*a* and may extend along the first edge portion 1*a*. In such case the tongue groove 5 is provided in and extends along the second edge portion 2*b*. In the vertically locked state of the first 1*a* and second 2*b* edge portions the longitudinal end portion 31 of the flexible tongue thus cooperates, such as engages, with the stop surface 6 on the second edge portion 2*b*, see FIGS. 2B, 2C, 3A-3D, 4A-C.

The flexible tongue 3 may be arranged in an insertion groove 4 in the second edge portion 2*b* and may extend along the second edge portion 2*b*. In such case the tongue groove 5 may be provided in and extends along the first edge portion 1*a*. In the vertically locked state of the first 1*a* and second 2*b* edge portions the longitudinal end portion 31 of the flexible tongue 3 may cooperate, such as engages, with the stop surface 6 on the first edge portion 1*a*, see FIGS. 5A-D, 6A and 6B.

Figure 7A:
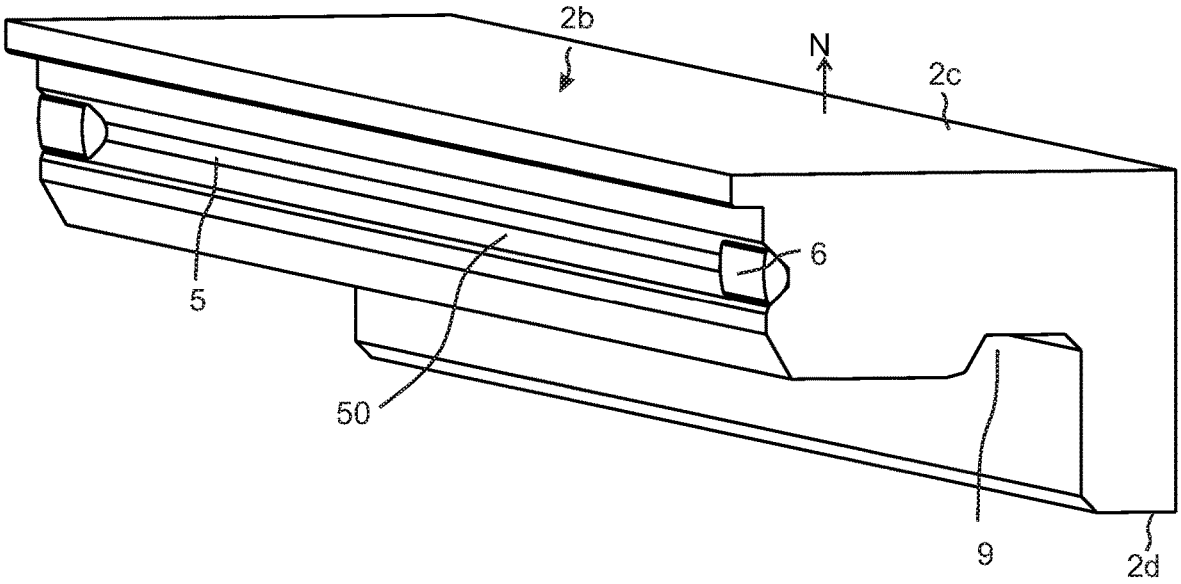
FIG. 7A shows an embodiment of the second edge portion of an embodiment of the second panel.
Figure 7B:
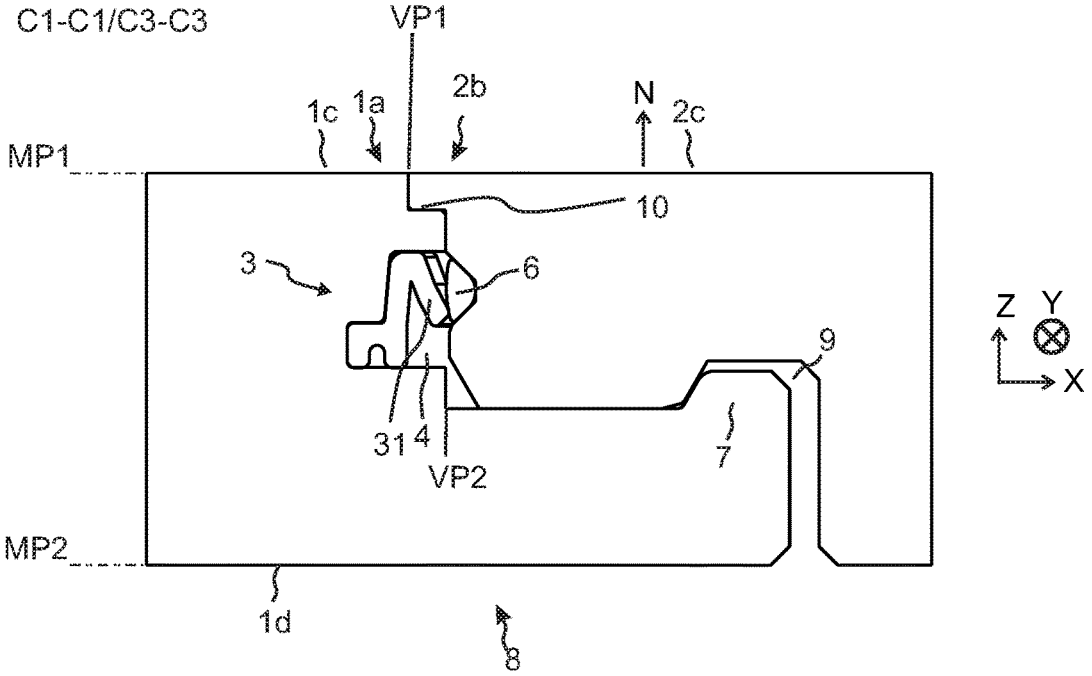
FIG. 7B shows a C1-C1 and a C3-C3 cross section of the embodiment in FIG. 7A.

The flexible tongue 3 in the insertion groove 4 being provided on either panel, i.e., on the first edge portion 1*a* or the second edge portion 2*b* may also be applied to FIGS. 7A-B. Accordingly, the tongue groove 5 may be provided in, and extending along, the other one of the first edge portion 1*a* and second edge portion 2*b*, such that the flexible tongue 3 may cooperate, such as engage, with the tongue groove 5.

The flexible portion 30 may be a pivoting member 32. The pivoting member may be of a flexible material, which springs back after having been biased for example during locking or unlocking.

The flexible portion 30 may be configured to be displaced (e.g., by pivoting) towards a bottom 40 of the insertion groove 4 during assembling and may be configured to spring back towards the locking surface 50 in the locked state.

The flexible portion may comprise an elastic joint 35, or a hinge which makes the flexible portion spring back after having been biased for example during locking or unlocking. These features of the pivoting member may be applicable to all embodiments of the disclosure.

The flexible portion may comprise a tip 36, which may cooperate with the locking surface 50 in the vertically locked state.

The flexible portion 30 may be a pivoting member 32. The pivoting member 32 may be biased by the stop surface 6 in said vertically locked state (see, e.g., FIGS. 2B, 3A, 3C, 5A, 5D and 7B). The pivoting member 32, such as the tip of the pivoting member, may be the part of the flexible tongue 3 that cooperates with the stop surface 6.

The angle alfa between the main plane MP1 and the locking surface may be 30-60°, such as 40-50°, such as about 45°. More specifically, the angle alfa between horizontal axis X and the locking surface may be 30-60°, such as 40-50°, such as about 45°. The angle alfa is shown in FIGS. 3D, SC, 11C and 12C, but may be applied to any embodiment.

Figure 3A:
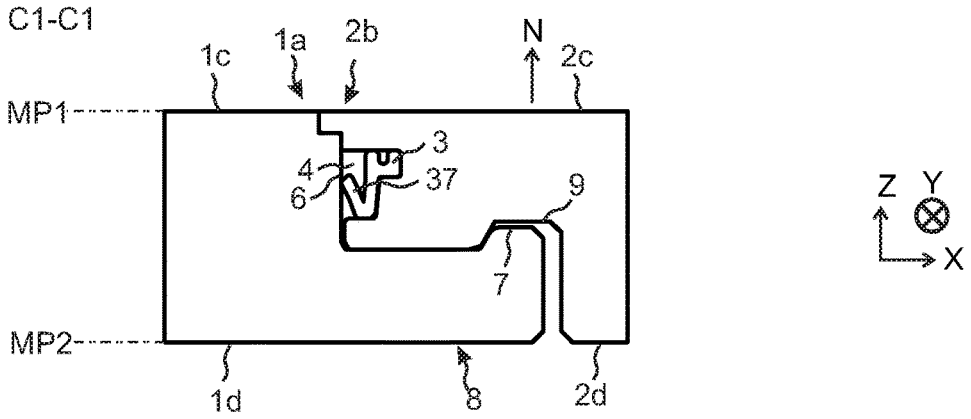
FIGS. 3A-3C show an embodiment in cross-sectional side views C1-C1, C2-C2 and C3-C3, respectively.
Figure 3B:
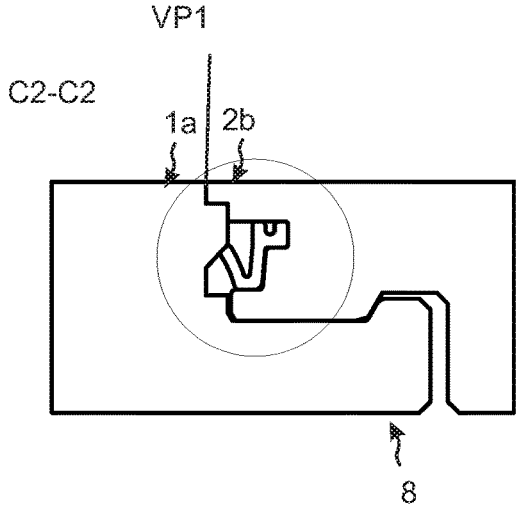
Figure 4A:
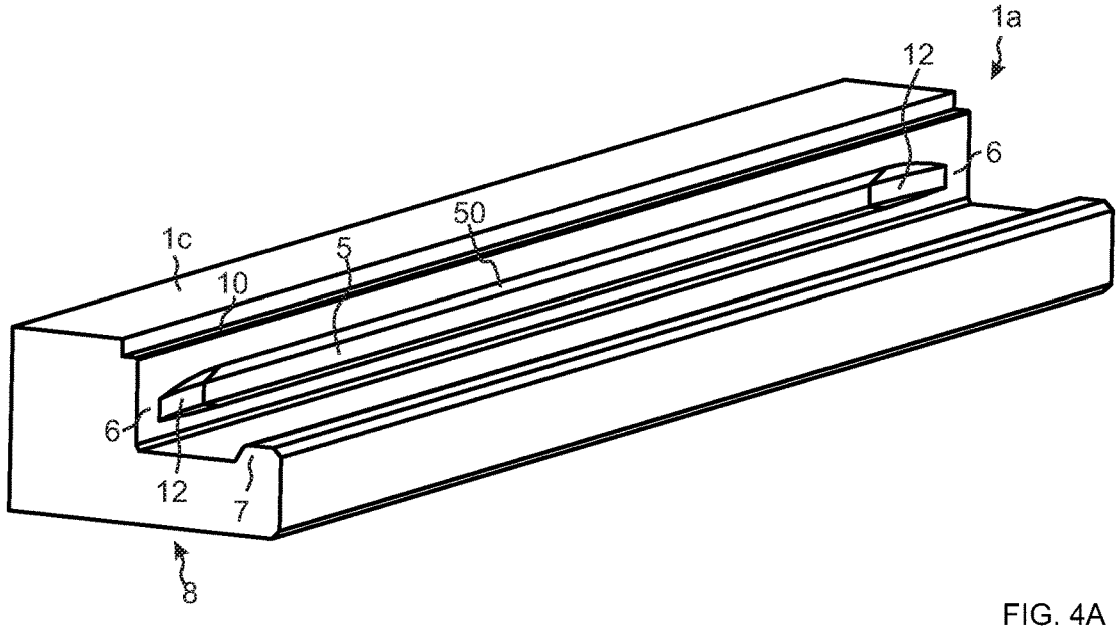
FIG. 4A shows an embodiment of a first edge portion of an embodiment of a first panel.
Figure 4B:
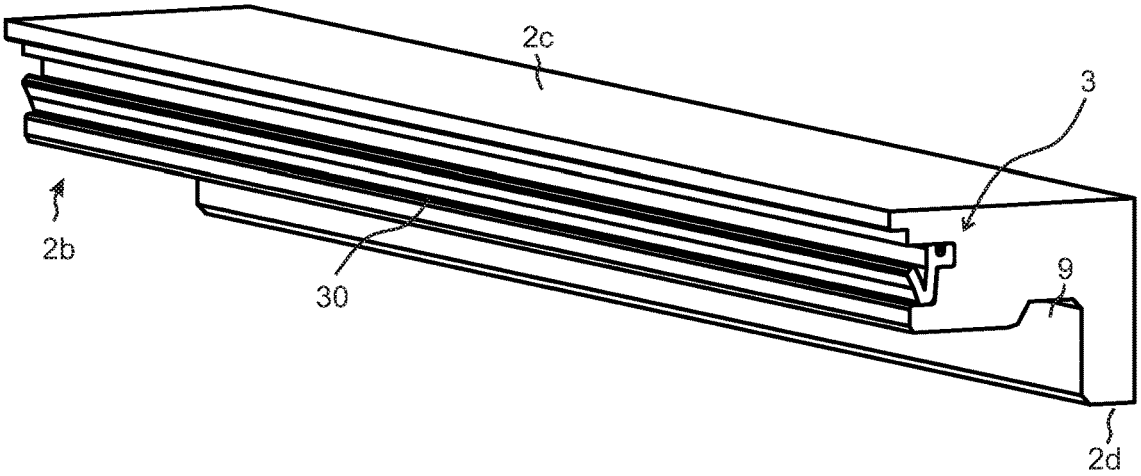
FIG. 4B shows an embodiment of a second edge portion of an embodiment of a second panel.
Figure 4C:
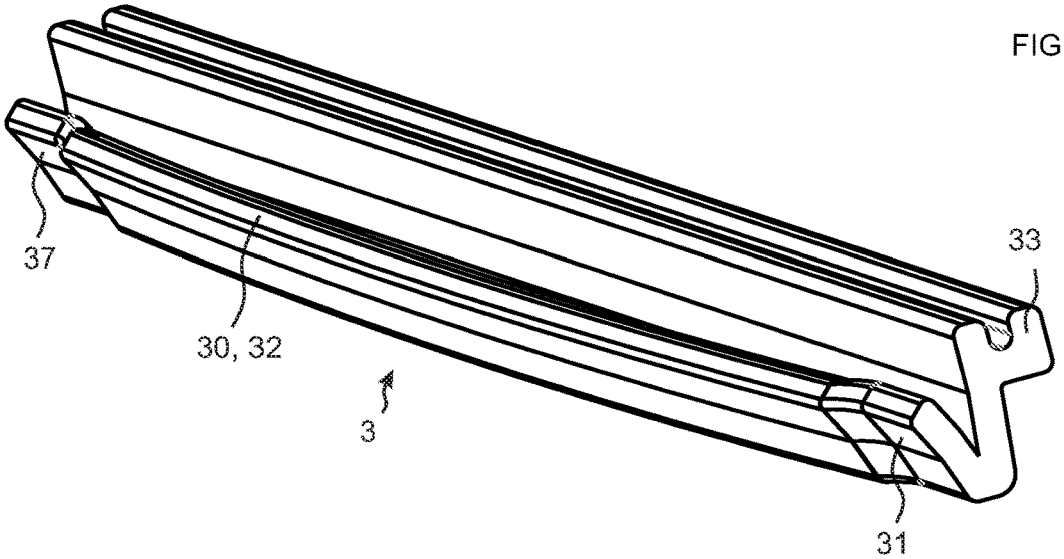
FIG. 4C shows in a perspective view an embodiment of the flexible tongue in a vertically locked state.

FIG. 4C shows the flexible tongue in the vertically locked state where the flexible portion has pivoted towards the inner portion 40 of the flexible tongue. This illustration may be applicable to embodiments in FIGS. 2B-C, 3A-C, 5A-D and 7B. Another perspective is shown in FIG. 6C.

The flexible portion 30 extends in a longitudinal direction along the flexible tongue 3. A part of the flexible portion 30 may protrude from the insertion groove 4 along most of the length of the flexible tongue 3 in the vertically locked state, such as a tip 36 of the flexible portion.

With reference to FIG. 4C, the flexible portion 30 of the flexible tongue 3 may be longitudinally slightly bent in the vertically locked state, such that the middle portion of the flexible portion 30 protrudes more than the ends. The bend is exaggerated in FIG. 4C in order to illustrate the principle. The slight bend may further facilitate the unlocking of the second edge portion 2*b* from the first edge portion 1*a*. The longitudinal end portion or end portions may be biased by the stop portion or stop portions 6.

The stop surface 6 may be essentially vertical, as shown in FIGS. 2B, 3A, 3C, 5A, 5D and 7B. The inclination of the stop surface may for example be 0-10° from the vertical axis Z, such as 0-5° from the vertical axis Z. The stop surface may be a portion of the first edge portion 1*a* or the second edge portion 2*b* (see, e.g., FIGS. 4A and 6B).

The first edge portion 1*a* or the second edge portion 2*b* may comprise an edge surface 11, which is optionally vertical. The edge surface 11 may comprise the tongue groove 5 and the stop surface 6. There may be stop surfaces 6 on opposing sides of the tongue groove 5, such as adjacent the tongue groove in the longitudinal direction, see, e.g., FIGS. 4A, 6B, 7A. The tongue groove 5 may be produced by a movable cutting tool, which creates chamfered ends 12 of the tongue groove. Thus, the stop surface 6 may basically be the edge surface 11, adjacent the end of the tongue groove.

The stop surface 6 may be provided adjacent to the tongue groove 5 in the longitudinal direction. Thus, the flexible tongue 3 may be longer than the tongue groove 5 (see, e.g., FIGS. 4A and 6B).

The stop surface 6 may be a piece of separate material, such as a polymer-based material, a wood-based material, or a filler, preferably provided in the tongue groove 5 (see FIG. 7A). A filler may be for example a curable compound.

With reference to FIGS. 2B-C, 3A-D and 5A-D, there may be a joint seam JS between the front surface 1*c*, 2*c* of the first panel and the second panel. The joint seam may be a gap. The surfaces into the edge portions from the joint seam JS may be angled or vertical. A vertical plane VP1 of the JS may be the same (FIGS. 2B-C) or different 3*a-d* and 5 *a-d*) from a vertical plane VP2 of the edge surface 11. There may be a shelf 10, which is preferably horizontal, between and horizontally separating the joint seam JS and the edge surface 11. The shelf is independent of the vertical locking device and may be applicable to any embodiment of the disclosure.

As shown in FIGS. 1B, 11A-11F and 12A-12F, the first 1*a* and second 2*b* edge portions may be configured to be vertically locked by a relative vertical displacement A, such as a fold-down movement A, of the second 2*b* edge portion towards the first edge portions 1*a*.

Figure 11A:
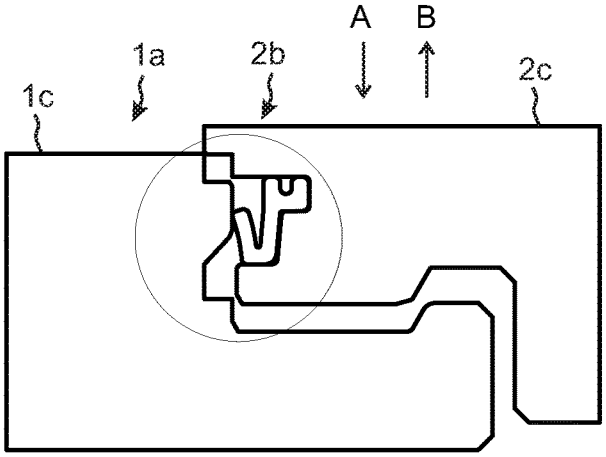
FIGS. 11A, 11C and 11E show a cross-sectional side view during assembling and disassembling of an embodiment of a second edge portion to an embodiment of the first edge portion.
Figure 11B:
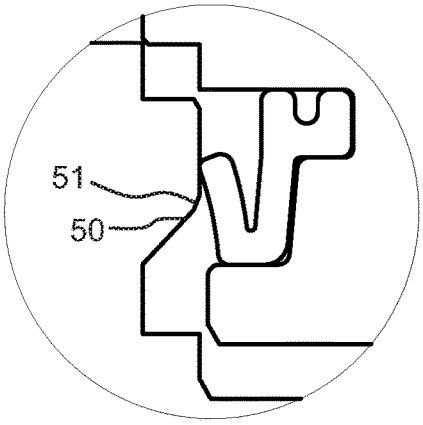
FIGS. 11B, 11D and 11F show enlargements of the encircled area in FIGS. 11A, 11C and 11E, respectively.
Figure 11C:
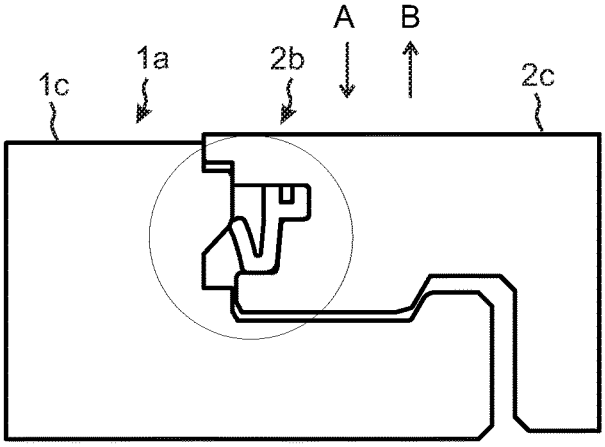
Figure 11D:
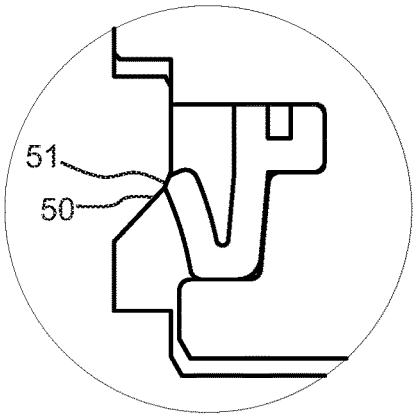
Figure 11E:
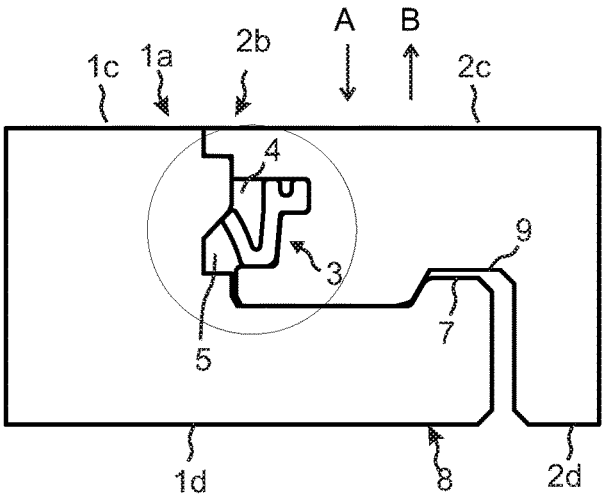
Figure 11F:
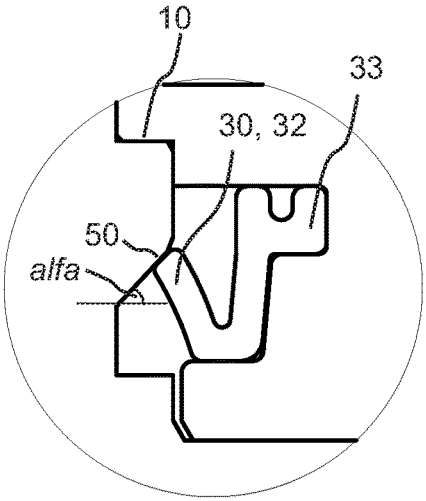

The locking may be illustrated by the sequence FIGS. 11A, 11C and 11E. FIGS. 11B, 11D and 11F shows and enlargement of the encircled area in FIGS. 11A, 11C and 11E, respectively. A vertical displacement A, such as a fold down movement, of the second 2*b* edge portion towards the first edge portions 1*a* starts with an unbiased flexible portion 30 of the flexible tongue 3. As the 2*b* edge portion is lowered the flexible portion meets the first edge portion 1*a* and the flexible portion 30, may be biased, such as pivoted towards the inner portion 33 of the flexible tongue. In FIG. 11A, the shelf 10 is the part which meets the flexible portion 30, but it may be any part of the first edge portion 1*a*, such as the front side 1*c* or the edge surface 11. The tip 36 of the flexible portion may be guided downwards the first edge portion 1*a*, such as the edge surface 11, towards the locking surface 50. In FIGS. 11C-D, the flexible portion 30 may pass the guiding surface 51 and the flexible portion, such as the pivoting member 32, starts moving away from the inner portion 33*a*. The flexible portion subsequently may reach the locking surface 50 and a vertical locking may be achieved. The longitudinal end portion 31 instead may reach the stop surface 6, such that no vertical locking is achieved (see FIG. 3A).

Figure 12A:
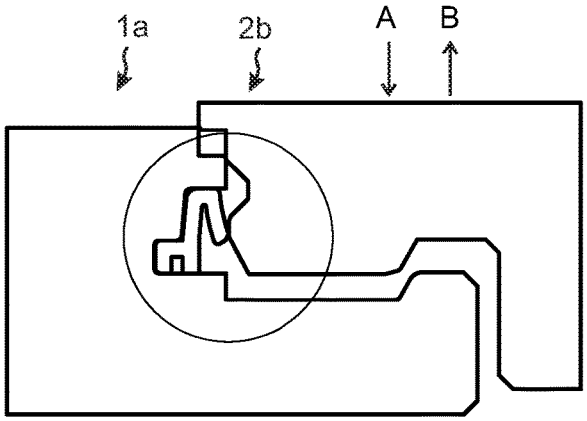
FIGS. 12A, 12C and 12E show a cross-sectional side view during assembling and disassembling of an embodiment of a second edge portion to an embodiment of the first edge portion.
Figure 12B:
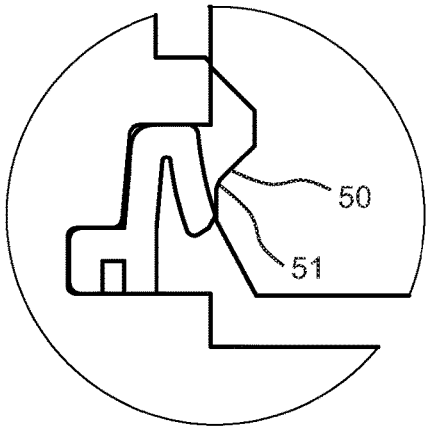
FIGS. 12B, 12D and 12F show enlargements of the encircled area in FIGS. 12A, 12C and 12E, respectively.
Figure 12C:
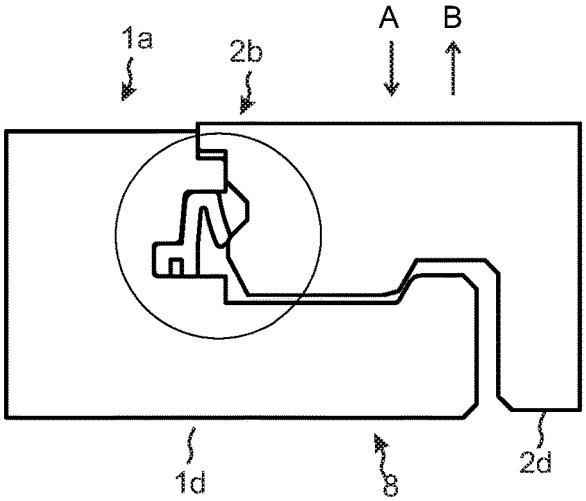
Figure 12D:
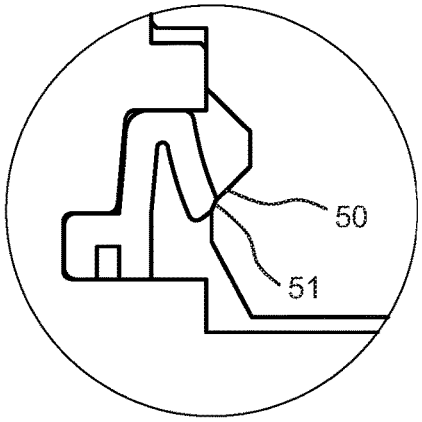
Figure 12E:
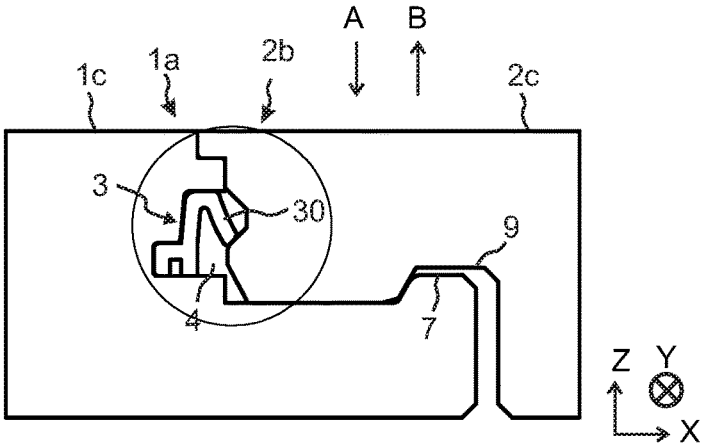
Figure 12F:
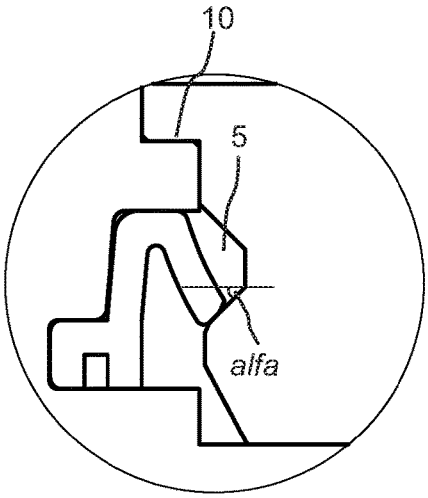

In embodiments, where the flexible tongue is in the first edge portion 1*a*, the locking may be illustrated by the sequence in FIGS. 12A-F. A vertical displacement A, such as a fold down movement, of the second 2*b* edge portion towards the first edge portions 1*a* starts with an unbiased flexible portion 30 of the flexible tongue 3. As the 2*b* edge portion is lowered the flexible portion meets the second edge portion 2*b* and the flexible portion 30, may be biased, such as pivoted towards the inner portion 33 of the flexible tongue. In FIG. 12A, the edge surface 11 is the part which meets the flexible portion 30, but it may be any part of the second edge portion 2*b*. The tip 36 of the flexible portion may be guided along the second edge portion 2*b*, such as the edge surface 11, towards the locking surface 50. In FIG. 12B, the flexible portion 30 may pass the guiding surface 51. The flexible portion 30, such as the pivoting member 32, starts moving away from the inner portion 33. The flexible portion subsequently may reach the locking surface 50 and a vertical locking may be achieved. The longitudinal end portion 31 of the flexible tongue 3 instead may reach the stop surface 6, such that no vertical locking is achieved (see, e.g., FIG. 5A).

With reference to FIGS. 11A-11F and 12A-12F, the first 1*a* and second 2*b* edge portions may be configured to be vertically unlocked by a relative vertical displacement B of the first 1*a* and second 2*b* edge portions away from each other and/or by a repeated relative vertical displacement of the first 1*a* and second 2*b* edge portions away from and towards each other.

Figure 3D:
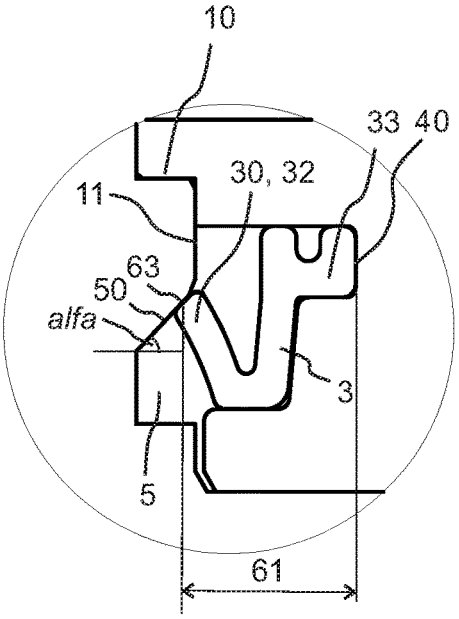
FIG. 3D shows an enlargement of the encircled portion in FIG. 3B.
Figure 3C:
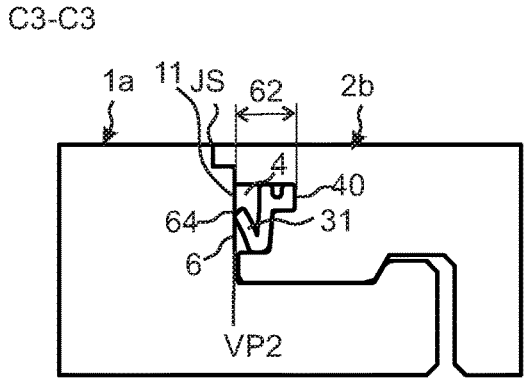
Figure 5A:
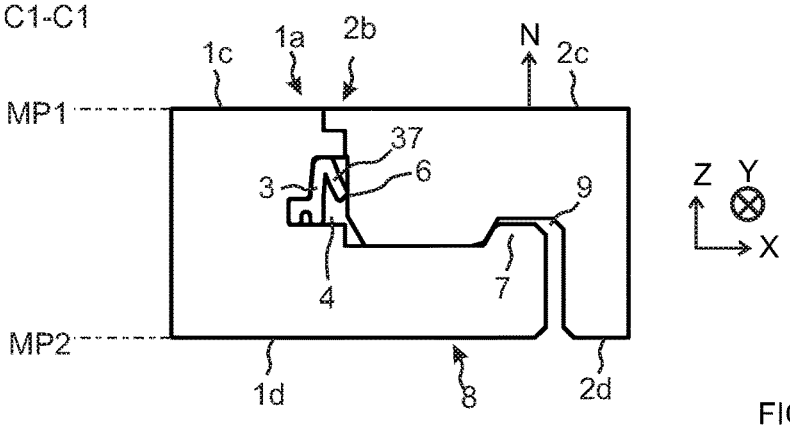
FIGS. 5A, 5B and 5D show an embodiment in cross-sectional side views C1-C1, C2-C2 and C3-C3, respectively.
Figure 5B:
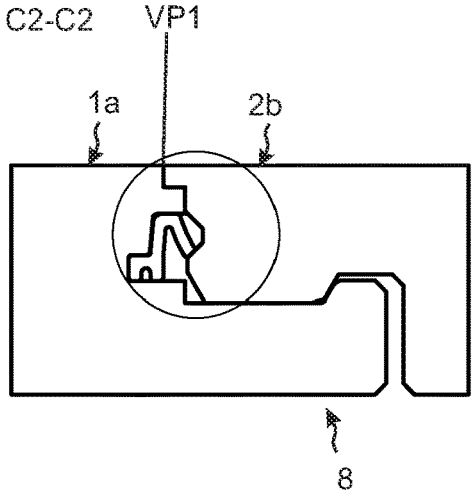
Figure 5C:
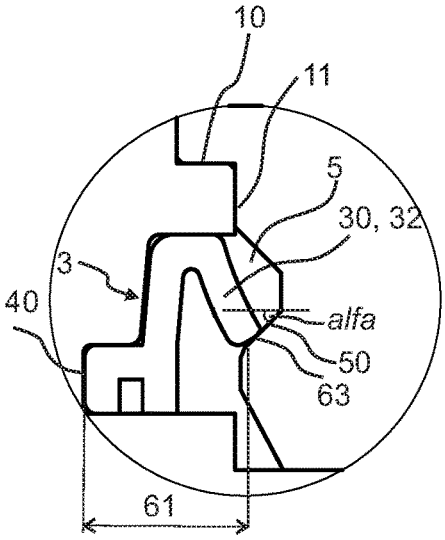
FIG. 5C is an enlargement of the encircled portion of FIG. 5B.
Figure 5D:
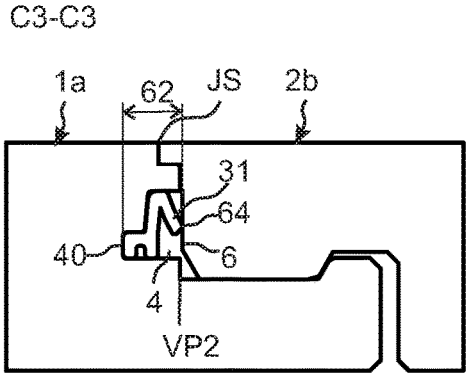
Figure 6A:
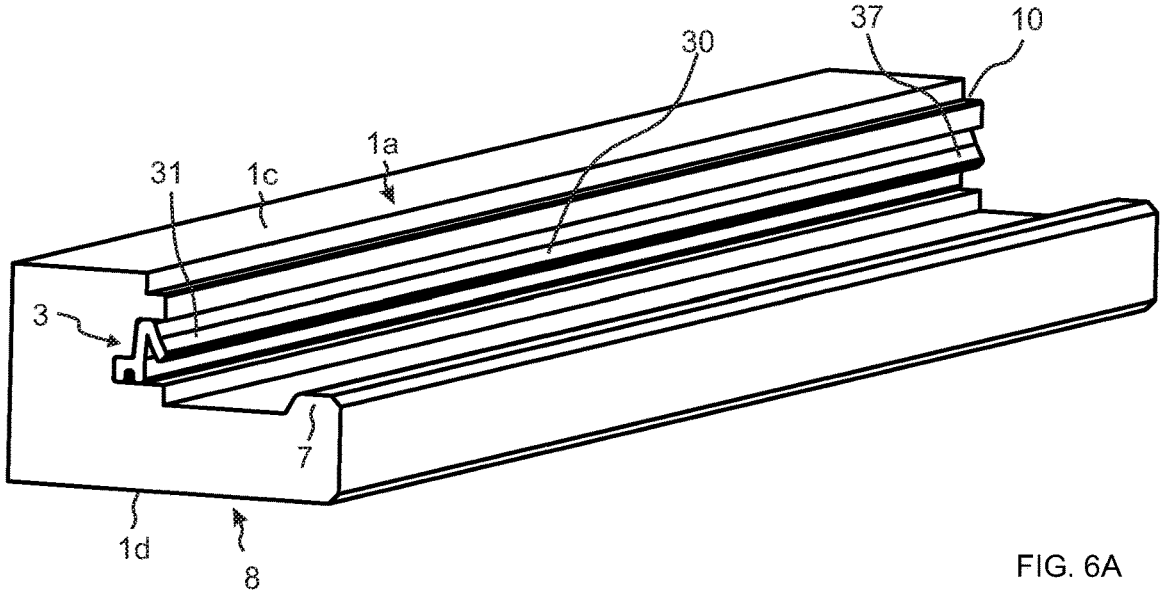
FIG. 6A shows an embodiment of the first edge portion of an embodiment of the first panel.
Figure 6B:
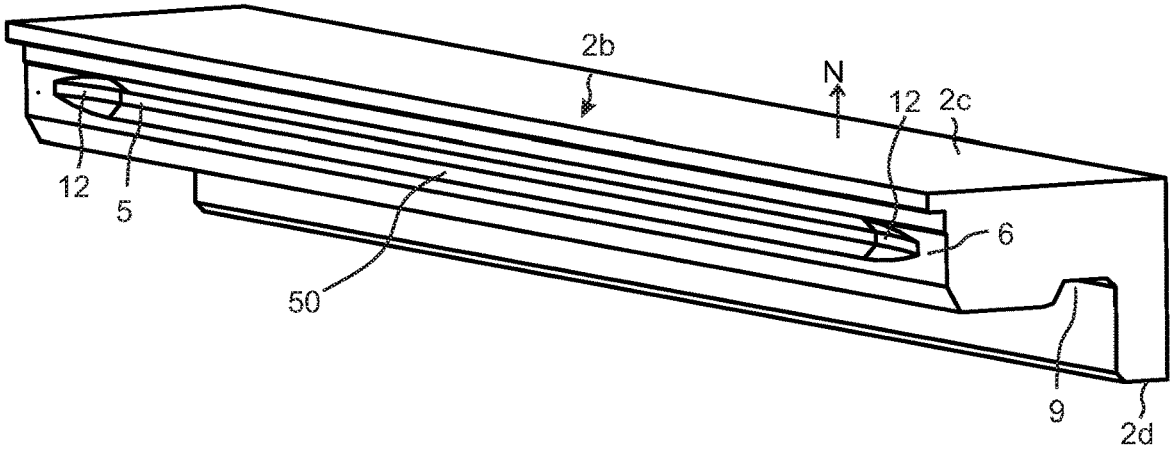
FIG. 6B shows an embodiment of a second edge portion of an embodiment of the second panel.
Figure 6C:
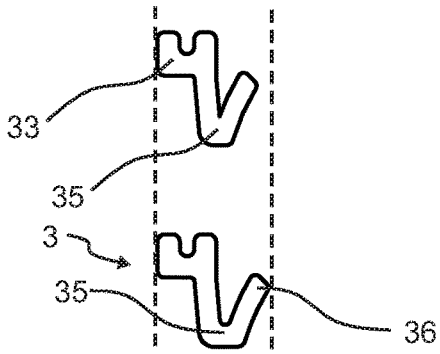
FIG. 6C shows a side view of an embodiment of the flexible tongue in a compressed state and in a non-compressed state.

The unlocking by relative vertical displacement B of one panel away from the other may be accomplished by virtue of the longitudinal end portion of the flexible tongue 3 not being locked, because the longitudinal end portion 31 of the flexible tongue cooperates with the stop surface 6 (see FIGS. 3A and 5A). The stop surface 6 may be essentially vertical and enables a small displacement upwards of the second edge 2*b* portion relative to the first 1*a* edge portion where the longitudinal end portion 31 is. This displacement causes a diminished cooperation with the locking surface of a slightly larger portion of the flexible tongue, enabling a further displacement upwards of the second edge portion relative to the first edge portion. The mechanism may be compared to the successive opening of a zipper.

This may be illustrated by FIGS. 11A-11F and 12A-12F. When the second edge surface 2*b* at the longitudinal end portion 31 is vertically displaced, the biased flexible portion 30 may be slightly less forced against the locking surface at the point along the joint seam JS between the first edge portion 1*a* and the second edge portion 2*b*, close to (adjacent) the longitudinal end portion. Another contributing force on the flexible portion 30 may be the vertical displacement B at the end portion. The state at this moment is still locked and shown in FIGS. 11C and 12C. At the point along the joint seam JS between the first edge portion 1*a* and the second edge portion 2*b*, the second edge portion 2*b* is displaced vertically and the flexible portion 30 may be aided by the guiding portion 51, which gradually pushes the tip of the flexible portion out of the tongue groove (see FIGS. 11B and 12B). With further vertical displacement B, the flexible portion of the flexible tongue may gradually lose its vertical locking and become pivoted out from the tongue groove 5 (see FIGS. 11A and 12A). Subsequently another point along the joint seam JS between the first edge portion 1*a* and the second edge portion 2*b*, the another point being slightly farther away from the longitudinal end portion 31, goes through a similar process and the locking between the first edge portion 1*a* and the second edge portion 2*b* may be gradually unlocked, as schematically shown in FIG. 1B, movement B.

The angle between horizontal axis X and the guiding surface may be 45-90°, such as 50-80°, such as 60-70°, such as about 75°. The guiding surface may be rounded.

The third 1*f*, 2*f* and fourth 1*e*, 2*e* opposing edge portions may also have a locking device, which is locked by an angling motion A as shown in FIG. 1B.

Figure 13A:
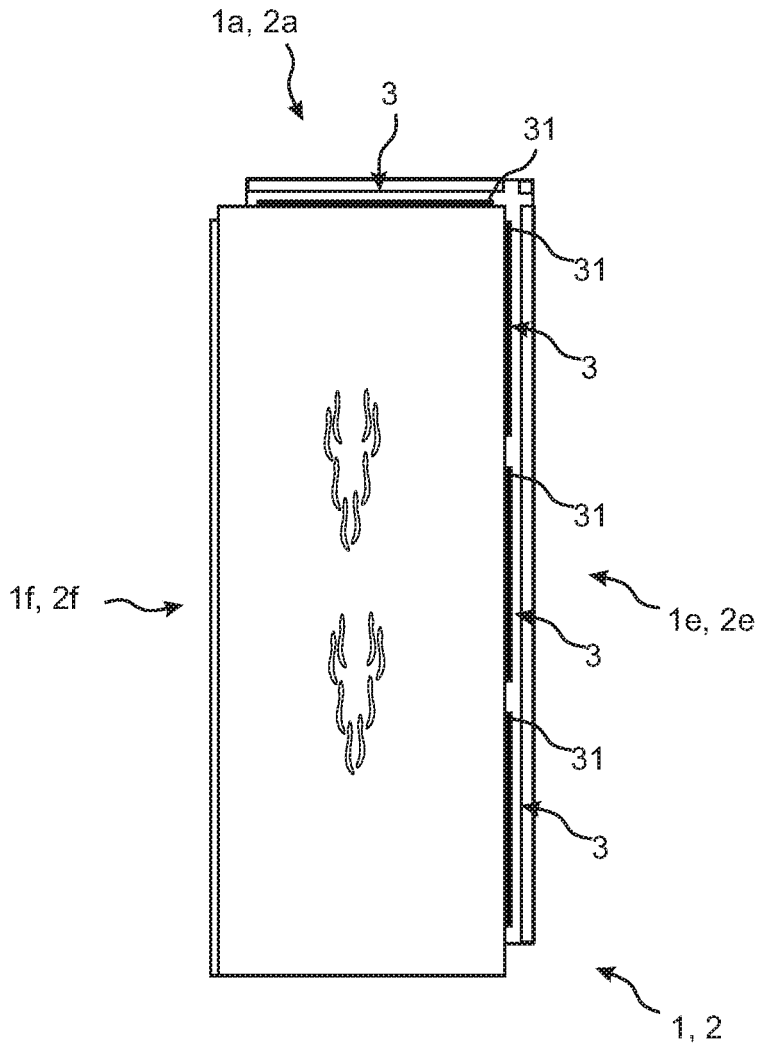
FIG. 13A illustrates that all sides of the panels may have an embodiment of the vertical locking device and that more than one locking tongue may be placed along an edge portion.

With reference to FIG. 13A, a third edge portion 1*f*, 2*f*, may also comprise one or more flexible tongues 3 arranged in an insertion groove 4. The flexible tongue 3 may extend along the third edge portion 1*f*, 2*f*. A fourth edge portion 1*e*, 2*e* may accordingly comprise one or more tongue grooves 5 provided in, and extending along, the fourth edge portion 1*e*, 2*e*. The flexible tongues 3 arranged in insertion grooves 4 may be arranged one after the other along the third edge portion 1*f*, 2*f*. The longitudinal end portion 31 may be oriented towards the same direction along the third edge portion 1*f*, 2*f*. The one or more tongue grooves 5 may be provided one after the other in the fourth edge portion 1*e*, 2*e* and may be configured to receive the flexible portion according to the first aspect of the disclosure. In a vertically locked state of the third 1*f* and fourth 2*e* edge portions: a flexible portion 30 of the flexible tongue 3 cooperates with a locking surface 50 in the tongue groove 5; and longitudinal end portions 31 of the flexible tongue 3 cooperate with stop surfaces 6 on the corresponding other edge portion according to the disclosure.

Although not shown, one or more flexible tongues 3 arranged in an insertion groove 4 may instead be provided in the fourth edge portion 1*e*, 2*e*. The flexible tongue 3 may extend along the fourth edge portion 1*e*, 2*e*. A third edge portion 1*f*, 2*f* may accordingly comprise one or more tongue grooves 5 provided in, and extending along, the third edge portion 1*f*, 2*f*. The flexible tongues 3 arranged in insertion grooves 4 may be arranged one after the other along the fourth edge portion 1*e*, 2*e*. The longitudinal end portion 31 may be oriented towards the same direction along the third edge portion 1*f*;2*f*. The one or more tongue grooves 5 may be provided one after the other in the third edge portion 1*f*, 2*f* and may be configured to receive the flexible portion according to the first aspect of the disclosure. In a vertically locked state of the third 1*f* and fourth 2*e* edge portions: a flexible portion 30 of the flexible tongue 3 cooperates with a locking surface 50 in the tongue groove 5; and longitudinal end portions 31 of the flexible tongue 3 cooperate with stop surfaces 6 on the corresponding other edge portion according to the disclosure.

According to a second aspect of the disclosure, there is provided a set of panels, such as building panels, comprising a first panel 1 and a second panel 2 and a locking device for locking a first edge portion 1*a* of the first panel to a second edge portion 2*b* of the second panel. The panels comprise a front side 1*c*; 2*c* and a rear side 1*d*; 2*d*, a main plane MP1; MP2 extending along the front and/or the rear side and a normal N of the main plane MP1; MP2) said normal N defining a vertical direction Z. The locking device comprises a horizontal locking device and a vertical locking device, the vertical locking device comprising a flexible tongue 3 arranged in an insertion groove 4 of one of said first edge portion 1*a* and said second edge portion 2*b*, said flexible tongue 3 extending along said one of said first edge portion 1*a* and said second edge portion 2*b*, and a tongue groove 5 provided in, and extending along the other of said one of said first edge portion 1*a* and said second edge portion 2*b* (see FIGS. 1A-B and 2A). In a vertically locked state of the first 1*a* and second 2*b* edge portions a flexible portion 30 of the flexible tongue 3 cooperates with a locking surface 50 in the tongue groove 5. Accordingly, the second aspect may have most features in common with the first aspect of the disclosure.

Figure 8A:
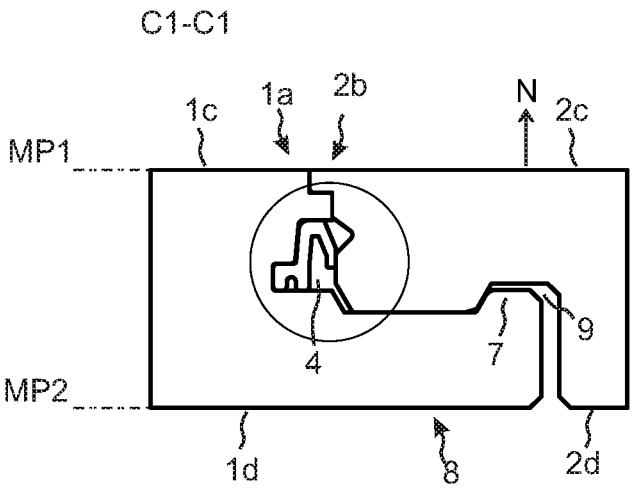
FIGS. 8A, 8C and BE show an embodiment in cross-sectional side views C1-C1, C2-C2 and C3-C3, respectively.
Figure 8B:
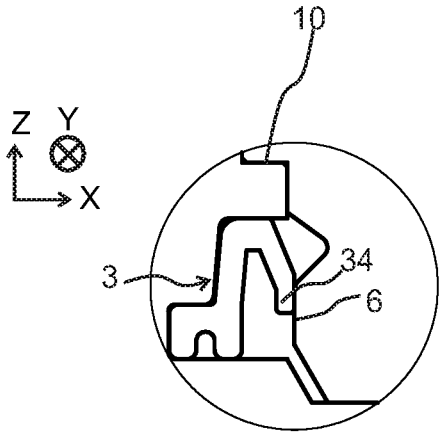
FIGS. 8B, 8D and 8F are enlargements of the encircled portion of FIGS. 8A, 8C and BE, respectively.
Figure 8C:
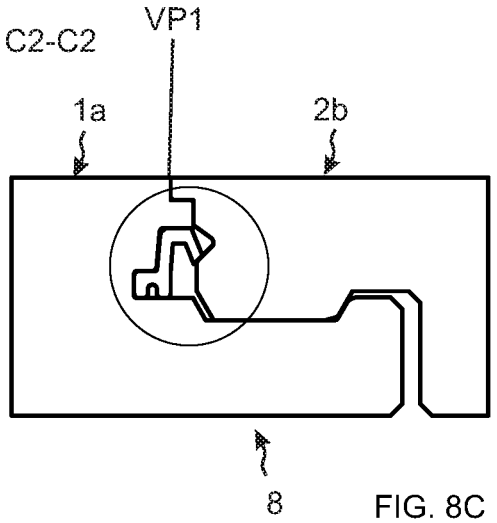
Figure 8D:
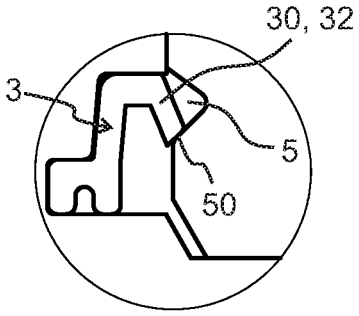
Figure 8E:
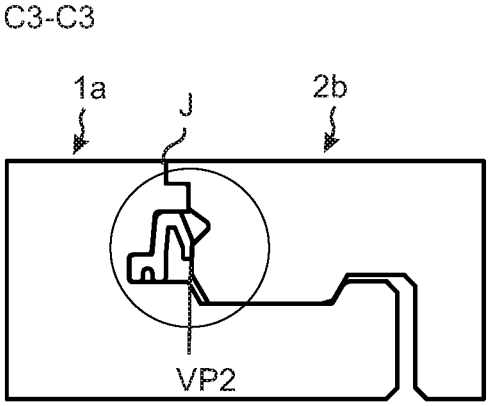
Figure 8F:
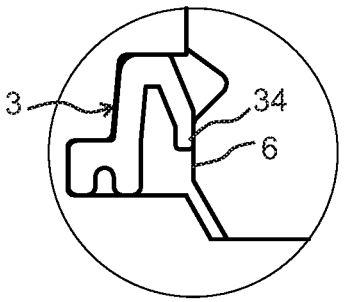
Figure 9A:
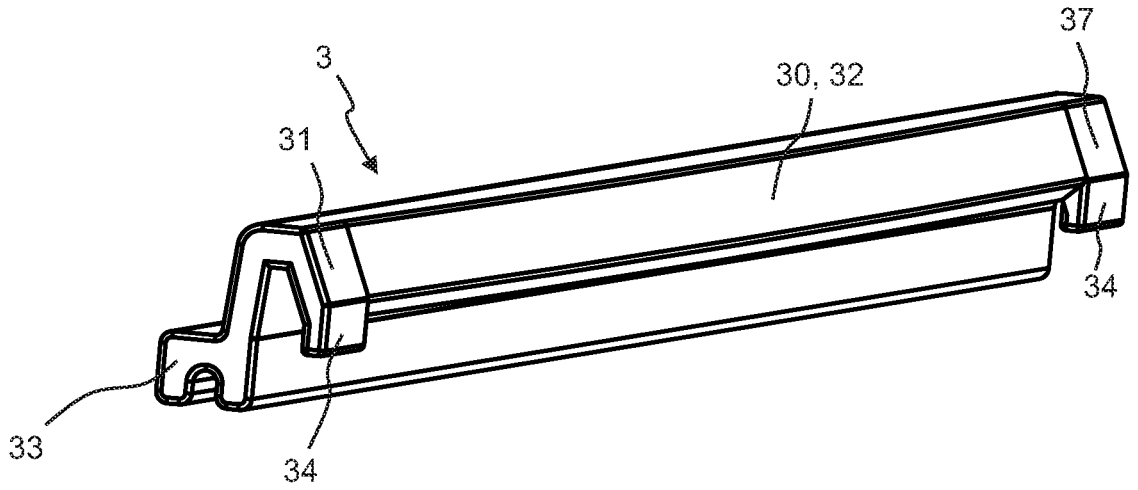
FIG. 9A shows in a 3D-view an embodiment of the flexible tongue shown in FIGS. 8A-8F in an unlocked state.
Figure 9B:
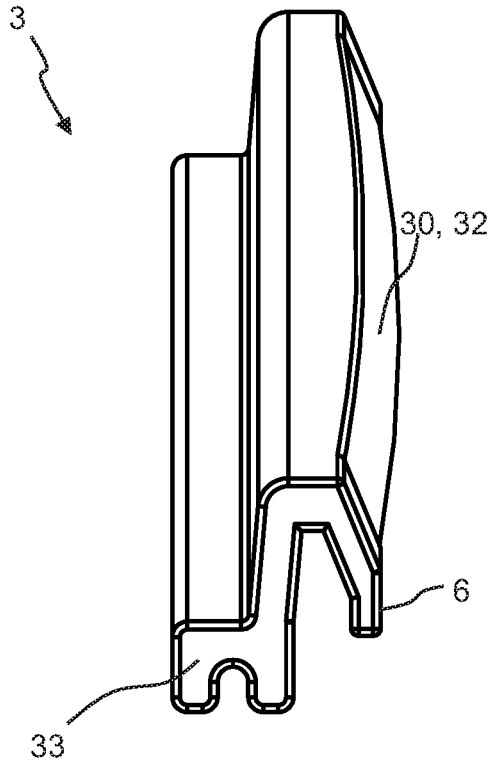
FIG. 9B shows in a 3D-view the embodiment of the flexible tongue shown in FIGS. 9A and 8A-8F in a locked state.

FIGS. 8A, 8C and BE show an embodiment in cross-sectional side views C1-C1, C2-C2 and C3-C3, respectively. FIGS. 8B, 8D and 8F are enlargements of the encircled portion of FIGS. 8A, 8C and BE, respectively. FIG. 9A shows in a 3D-view an embodiment of the flexible tongue shown in FIGS. 8A-8E in an unlocked state. FIG. 9B shows in a 3D-view the embodiment of the flexible tongue shown in FIGS. 9A and 8A-8E in a locked state. The shown embodiment of the embodiment of the flexible 3 may comprise at a longitudinal end portion 31 and/or an opposite longitudinal end portion 37 of the flexible tongue 3 an abutment member 34. The abutment member 34 may cooperate with a stop surface 6 on the other of said one of said first edge portion 1*a* and said second edge portion 2*b*. The stop surface 6 being closer to a bottom 40 of said insertion groove 4 than said locking surface 50.

The flexible tongue may be inserted in an insertion groove 4 in the first edge portion 1*a* and the tongue groove 5 is in the second edge portion 2*b*. This may be the other way around in a similar manner to the first aspect of the disclosure.

According to a third aspect of the disclosure, there is provided a set of panels, such as building panels, comprising a first panel 1 and a second panel 2 and a locking device for locking a first edge portion 1*a* of the first panel to a second edge portion 2*b* of the second panel. The panels comprise a front side 1*c*; 2*c* and a rear side 1*d*; 2*d*, a main plane MP1; MP2 extending along the front and/or the rear side and a normal N of the main plane MP1; MP2 said normal N defining a vertical direction Z. The locking device comprises a horizontal locking device and a vertical locking device, the vertical locking device comprising a flexible tongue 3 arranged in an insertion groove 4 of one of said first edge portion 1*a* and said second edge portion 2*b*, said flexible tongue 3 extending along said one of said first edge portion 1*a* and said second edge portion 2*b*, and a tongue groove 5 provided in, and extending along the other of said one of said first edge portion 1*a* and said second edge portion 2*b* (see FIGS. 1A-B and 2A). In a vertically locked state of the first 1*a* and second 2*b* edge portions a flexible portion 30 of the flexible tongue 3 cooperates with a locking surface 50 in the tongue groove 5. Accordingly, the third aspect of the disclosure may have most features in common with the first aspect of the disclosure.

Figure 10A:
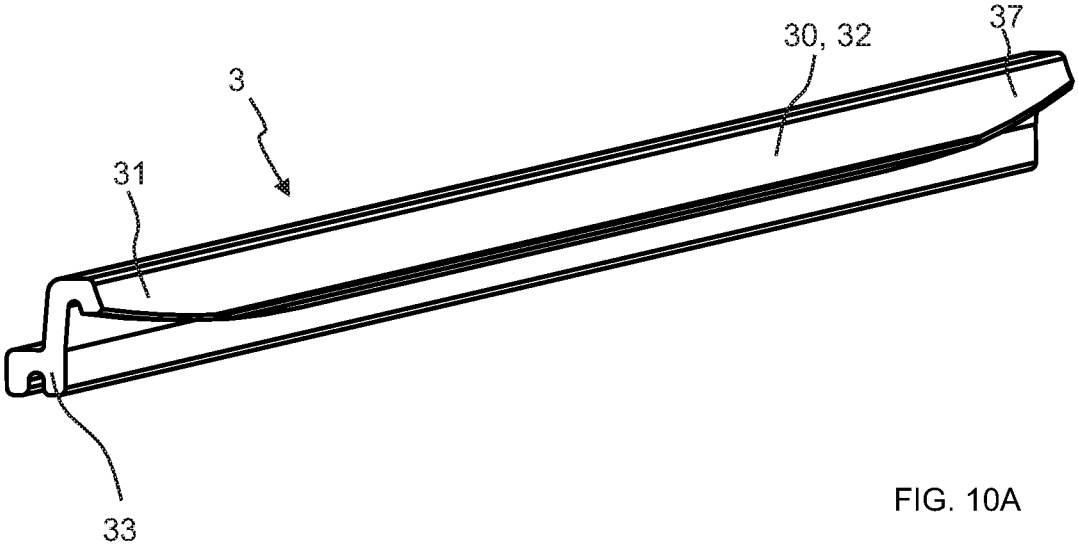
FIG. 10A shows in a 3D-view an embodiment of the flexible tongue in an unlocked state.
Figure 10B:
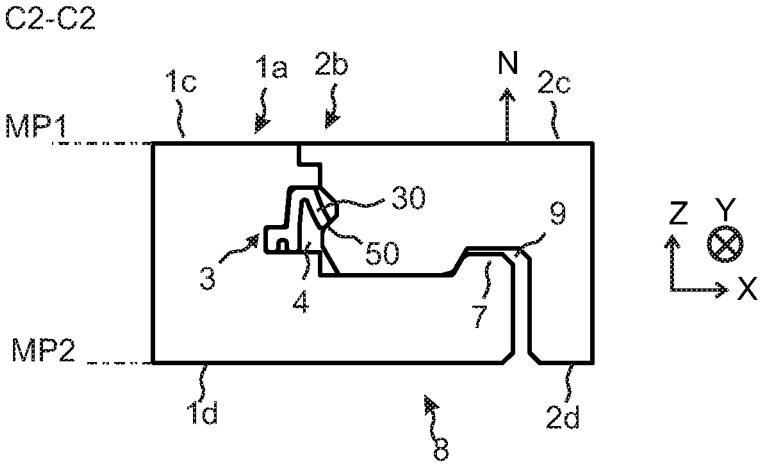
FIG. 10B-10C show an embodiment in cross-sectional side views C2-C2 and C1-C1/C3-C3, respectively, which includes the embodiment of the flexible tongue shown in FIG. 10A.
Figure 10C:
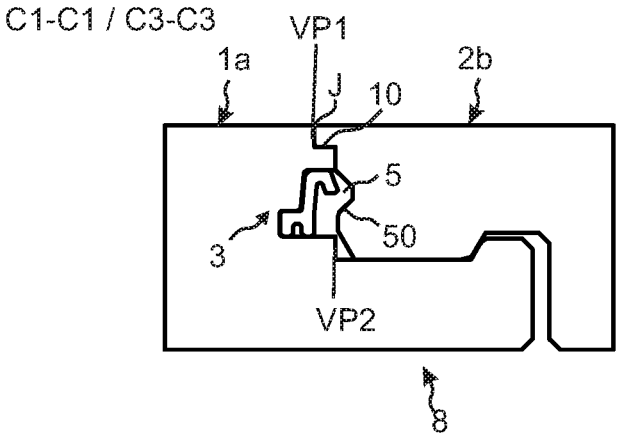

With reference to FIGS. 10A-C, the differing features comprise that in a vertically locked state a longitudinal end portion 31 of the flexible portion 30 is beveled such that the vertical locking is gradually reduced, such as reduced to no vertical locking, towards the end of the longitudinal end portion 31. In the embodiment depicted in FIGS. 10A-C, the flexible tongue is inserted in an insertion groove 4 in the first edge portion 1*a*, whereas the tongue groove 5 is in the second edge portion 2*b*, but according to embodiments this may be the other way around in a similar manner as the first aspect of the disclosure.

Itemized List of Embodiments

1. A set of panels, such as building panels, comprising a first panel (1) and a second panel (2) and a locking device for locking a first edge portion (1*a*) of the first panel to a second edge portion (2*b*) of the second panel, wherein the panels comprise a front side (1*c*; 2*c*) and a rear side (1*d*; 2*d*), a main plane (MP1; MP2) extending along the front and/or the rear side and a normal (N) of the main plane (MP1; MP2), said normal (N) defining a vertical direction (Z), wherein the locking device comprises a horizontal locking device and a vertical locking device, the vertical locking device comprising:
   a flexible tongue (3) arranged in an insertion groove (4) of one of said first edge portion (1*a*) and said second edge portion (2*b*), said flexible tongue (3) extending along said one of said first edge portion (1*a*) and said second edge portion (2*b*), and a tongue groove (5) provided in, and extending along the other of said one of said first edge portion (1*a*) and said second edge portion (2*b*),
   wherein in a vertically locked state of the first (1*a*) and second (2*b*) edge portions:
   a flexible portion (30) of the flexible tongue (3) cooperates with a locking surface (50) in the tongue groove (5); and
   a longitudinal end portion (31) of the flexible tongue (3) cooperates with a stop surface (6) on the other of said one of said first edge portion (1*a*) and said second edge portion (2*b*), said stop surface (6) being closer to a bottom (40) of said insertion groove (4) than said locking surface (50).
2. The set of panels according to item 1, wherein the stop surface (6) is essentially vertical, such as the inclination of the stop surface is 0-10° from the vertical axis Z, such as 0-5° from the vertical axis Z.
3. The set of panels according to item 1 or 2, wherein the stop surface (6) is provided adjacent to the tongue groove 5 in the longitudinal direction.
4. The set of panels according to any one of items 1 to 3, wherein the flexible tongue (3) is longer than the tongue groove (5).
5. The set of panels according to any one of items 1, 2 and 4, wherein the stop surface (6) is part of a piece of separate material, such as a polymer-based material, a wood-based material, or a filler, preferably provided in the tongue groove (5).
6. The set of panels according to any of the preceding items, wherein the first edge portion (1*a*) of the first panel and the second edge portions (2*b*) of the second panel are short edge portions.
7. The set of panels according to any of the preceding items, wherein a part of the flexible portion (30) protrudes from the insertion groove (4) along most of the length of the flexible tongue (3) in the vertically locked state.
8. The set of panels according to any of the preceding items, wherein a stop surface (6) is provided on opposing sides of the tongue groove (5).
9. The set of panels according to any of the preceding items, wherein the flexible portion (30) is a pivoting member (32), said member being biased by the stop surface (6) in said vertically locked state.
10. The set of panels according to any of the preceding items, wherein the flexible tongue (3) comprises an inner portion (33) configured to face the bottom (40) of the insertion groove (4) when arranged therein.
11. The set of panels according to any of the preceding items, wherein the flexible tongue (3) is arranged in an insertion groove (4) in the first edge portion (1*a*), said flexible tongue (3) extending along said first edge portion (1*a*); and the tongue groove (5) is provided in, and extending along the second edge portion (2*b*),
   wherein in a vertically locked state of the first (1*a*) and second (2*b*) edge portions the longitudinal end portion (31) of the flexible tongue cooperates with a stop surface (6) on the second edge portion (2*b*).
12. The set of panels according to any one of items 1 to 10, wherein the flexible tongue (3) is arranged in an insertion groove (4) in the second edge portion (2*b*), said flexible tongue (3) extending along said second edge portion (2*b*); and
   the tongue groove (5) is provided in, and extending along the first edge portion (1*a*), wherein in a vertically locked state of the first (1*a*) and second (2*b*) edge portions the longitudinal end portion (31) of the flexible tongue cooperates with a stop surface (6) on the first edge portion (1*a*).
13. The set of panels according to any of the preceding items, wherein the horizontal locking device comprises a locking element (7) arranged on a strip (8) extending horizontally outwards from a lower portion of the first edge portion (1*a*) and a locking groove (9) provided in the second edge portion (2*b*), the locking element (7) and the locking groove (8) being configured to cooperate to provide a horizontally locked state of the first (1*a*) and the second (2*b*) edge portions.
14. The set of panels according to any of the preceding items, wherein the first (1*a*) and second (2*b*) edge portions are configured to be vertically unlocked by a relative vertical displacement of the first and second edge portions away from each other and/or by a repeated relative vertical displacement of the first and second edge portions away from and towards each other.

15. The set of panels according to any of the preceding items, wherein there is a shelf (10), which is preferably horizontal, between a joint seam (JS), between the front side 1*c* of the first panel and the front side 2*c* of the second panel, and the tongue groove (5) or the insertion groove (4).

16. A set of panels, such as building panels, comprising a first panel (1) and a second panel (2) and a locking device for locking a first edge portion (1*a*) of the first panel to a second edge portion (2*b*) of the second panel, wherein the panels comprise a front side (1*c*; 2*c*) and a rear side (1*d*; 2*d*), a main plane (MP1; MP2) extending along the front and/or the rear side and a normal (N) of the main plane (MP1; MP2), said normal (N) defining a vertical direction (Z), wherein the locking device comprises a horizontal locking device and a vertical locking device, the vertical locking device comprising:

a flexible tongue (3) arranged in an insertion groove (4) of one of said first edge portion (1*a*) and said second edge portion (2*b*), said flexible tongue (3) extending along said one of said first edge portion (1*a*) and said second edge portion (2*b*), and a tongue groove (5) provided in, and extending along the other of said one of said first edge portion (1*a*) and said second edge portion (2*b*), wherein in a vertically locked state of the first (1*a*) and second (2*b*) edge portions:

a flexible portion (30) of the flexible tongue (3) cooperates with a locking surface (50) in the tongue groove (5); and a longitudinal end portion (31) of the flexible tongue (3) comprises an abutment member, said abutment member (34) cooperating with a stop surface (6) on the other of said one of said first edge portion (1*a*) and said second edge portion (2*b*), said stop surface (6) being closer to a bottom (40) of said insertion groove (4) than said locking surface (50).

17. The set of panels according to item 16, wherein the stop surface (6) is essentially vertical, such as the inclination of the stop surface is 0-10° from the vertical axis Z, such as 0-5° from the vertical axis Z.

18. The set of panels according to item 16 or 17, wherein the stop surface (6) is provided below the tongue groove (5).

19. The set of panels according to any one of items 16 to 18, wherein the first edge portion (1*a*) of the first panel and the second edge portions (2*b*) of the second panel are short edge portions.

20. The set of panels according to any one of items 16 to 19, wherein a part of the flexible portion (30) protrudes from the insertion groove (4) along most of the length of the flexible tongue (3) in the vertically locked state.

21. The set of panels according to any one of items 16 to 20, wherein abutment members (34) are provided on opposing longitudinal end portions of the flexible tongue (3).

22. The set of panels according to any one of items 16 to 21, wherein the flexible portion (30) is a pivoting member (32).

23. The set of panels according to any one of items 16 to 22, wherein the flexible tongue (3) comprises an inner portion (33) configured to face the bottom (40) of the insertion groove (4) when arranged therein.

24. The set of panels according to any one of items 16 to 23, wherein the flexible tongue (3) is arranged in an insertion groove (4) in the first edge portion (1*a*), said flexible tongue (3) extending along said first edge portion (1*a*); and the tongue groove (5) is provided in, and extending along, the second edge portion (2*b*), wherein in a vertically locked state of the first (1*a*) and second (2*b*) edge portions the abutment member (34) of the flexible tongue (3) cooperates with a stop surface (6) on the second edge portion (2*b*).

25. The set of panels according to any one of items 16 to 23, wherein the flexible tongue (3) is arranged in an insertion groove (4) in the second edge portion (2*b*), said flexible tongue (3) extending along said second edge portion (2*b*); and the tongue groove (5) is provided in, and extending along the first edge portion (1*a*), wherein in a vertically locked state of the first (1*a*) and second (2*b*) edge portions the abutment member (34) of the flexible tongue cooperates with a stop surface (6) on the first edge portion (1*a*).

26. The set of panels according to any one of items 16 to 25, wherein the horizontal locking device comprises a locking element (7) arranged on a strip (8) extending horizontally outwards from a lower portion of the first edge portion (1*a*) and a locking groove (9) provided in the second edge portion (2*b*), the locking element (7) and the locking groove (8) being configured to cooperate to provide a horizontally locked state of the first (1*a*) and the second (2*b*) edge portions.

27. The set of panels according to any one of items 16 to 26, wherein the first (1*a*) and second (2*b*) edge portions are configured to be vertically unlocked by a relative vertical displacement of the first and second edge portions away from each other and/or by a repeated relative vertical displacement of the first and second edge portions away from and towards each other.

28. The set of panels according to any one of items 16 to 27, wherein there is a shelf (10), which is preferably horizontal, between a joint seam (JS), between the front side 1*c* of the first panel and the front side 2*c* of the second panel, and the tongue groove (5) or the insertion groove (4).

29. A set of panels, such as building panels, comprising a first panel (1) and a second panel (2) and a locking device for locking a first edge portion (1*a*) of the first panel to a second edge portion (2*b*) of the second panel, wherein the panels comprise a front side (1*c*; 2*c*) and a rear side (1*d*; 2*d*), a main plane (MP1; MP2) extending along the front and/or the rear side and a normal (N) of the main plane (MP1; MP2), said normal (N) defining a vertical direction (Z), wherein the locking device comprises a horizontal locking device and a vertical locking device, the vertical locking device comprising:

a flexible tongue (3) arranged in an insertion groove (4) of one of said first edge portion (1*a*) and said second edge portion (2*b*), said flexible tongue (3) extending along said one of said first edge portion (1*a*) and said second edge portion (2*b*), and a tongue groove (5) provided in, and extending along the other of said one of said first edge portion (1*a*) and said second edge portion (2*b*), wherein in a vertically locked state of the first (1*a*) and second (2*b*) edge portions:

a flexible portion (30) of the flexible tongue (3) cooperates with a locking surface (50) in the tongue groove (5); and a longitudinal end portion (31) of the flexible portion (30) is beveled such that the vertical locking is gradually reduced, such as reduced to no vertical locking, towards the end of the longitudinal end portion (31).

30. The set of panels according to item 29, wherein the first edge portion (1*a*) of the first panel and the second edge portions (2*b*) of the second panel are short edge portions.

31. The set of panels according to item 29 or 30, wherein a part of the flexible portion (30) protrudes from the insertion groove (4) along most of the length of the flexible tongue (3) in the vertically locked state.

32. The set of panels according to any one of items 29 to 31, wherein the longitudinal end portions (31) are both beveled.

33. The set of panels according to any one of items 29 to 32, wherein the flexible portion (30) is a pivoting member (32).

34. The set of panels according to any one of items 29 to 33, wherein the flexible tongue (3) comprises an inner portion (33) configured to face the bottom (40) of the insertion groove (4) when arranged therein.

35. The set of panels according to any one of items 29 to 34, wherein the flexible tongue (3) is arranged in an insertion groove (4) in the first edge portion (1*a*), said flexible tongue (3) extending along said first edge portion (1*a*); and the tongue groove (5) is provided in, and extending along, the second edge portion (2*b*).

36. The set of panels according to any one of items 29 to 34, wherein the flexible tongue (3) is arranged in an insertion groove (4) in the second edge portion (2*b*), said flexible tongue (3) extending along said second edge portion (2*b*); and the tongue groove (5) is provided in, and extending along, the first edge portion (1*a*).

37. The set of panels according to any one of items 29 to 36, wherein the horizontal locking device comprises a locking element (7) arranged on a strip (8) extending horizontally outwards from a lower portion of the first edge portion (1*a*) and a locking groove (9) provided in the second edge portion (2*b*), the locking element (7) and the locking groove (8) being configured to cooperate to provide a horizontally locked state of the first (1*a*) and the second (2*b*) edge portions.

38. The set of panels according to any one of items 29 to 37, wherein the first (1*a*) and second (2*b*) edge portions are configured to be vertically unlocked by a relative vertical displacement of the first and second edge portions away from each other and/or by a repeated relative vertical displacement of the first and second edge portions away from and towards each other.

39. The set of panels according to any one of items 29 to 38, wherein there is a shelf (10), which is preferably horizontal, between a joint seam (JS), between the front side 1*c* of the first panel and the front side 2*c* of the second panel, and the tongue groove (5) or the insertion groove (4).

The invention claimed is:

1. A set of panels comprising a first panel and a second panel and a locking device for locking a first edge portion of the first panel to a second edge portion of the second panel, wherein the panels comprise a front side and a rear side, a main plane extending along the front and/or the rear side and a normal of the main plane, said normal defining a vertical direction, wherein the locking device comprises a horizontal locking device and a vertical locking device, wherein the vertical locking device comprises a flexible tongue arranged in an insertion groove of one of said first edge portion and said second edge portion, said flexible tongue extends along said one of said first edge portion and said second edge portion, and the other of said one of said first edge portion and said second edge portion comprises a tongue groove and a stop surface at an outer end of the tongue groove in a longitudinal direction of the tongue groove, wherein the flexible tongue comprises a longitudinal end portion and an opposite longitudinal end portion, and a flexible portion between the longitudinal end portion and the opposite longitudinal end portion, wherein in a vertically locked state of the first and the second edge portions the flexible portion is configured to cooperate with a locking surface in the tongue groove and the longitudinal end portion is configured to cooperate with the stop surface, wherein the flexible portion is a pivoting member which is configured to pivot towards a bottom of the insertion groove during assembling of the first edge portion and the second edge portion and is configured to spring back towards the locking surface in the vertically locked state, wherein said stop surface is closer than said locking surface to the bottom of the insertion groove.

2. The set of panels according to claim 1, wherein the stop surface is essentially vertical.

3. The set of panels according to claim 1, wherein the stop surface is provided adjacent to the tongue groove in the longitudinal direction.

4. The set of panels according to claim 1, wherein the flexible tongue is longer than the tongue groove.

5. The set of panels according to claim 1, wherein the stop surface is part of a piece of separate material which is separate from the other of said one of said first edge portion.

6. The set of panels according to claim 1, wherein the first edge portion of the first panel is a short edge portion of the first panel which is shorter than a long edge portion of the first panel, and the second edge portion of the second panel is a short edge portion of the second panel which is shorter than a long edge portion of the second panel.

7. The set of panels according to claim 1, wherein a part of the flexible portion protrudes from the insertion groove along most of the length of the flexible tongue in the vertically locked state.

8. The set of panels according to claim 1, wherein a second stop surface is provided at a second outer end of the tongue groove which is opposite to the outer end of the tongue groove in the longitudinal direction of the tongue groove.

9. The set of panels according to claim 1, wherein the pivoting member is biased by the stop surface in said vertically locked state.

10. The set of panels according to claim 1, wherein the flexible tongue comprises an inner portion configured to face the bottom of the insertion groove when arranged in the insertion groove.

11. The set of panels according to claim 1, wherein the flexible tongue is arranged in the insertion groove in the first edge portion, said flexible tongue extending along said first edge portion; and the tongue groove is provided in, and extending along the second edge portion, wherein in a vertically locked state of the first and second edge portions the longitudinal end portion of the flexible tongue cooperates with the stop surface on the second edge portion.

12. The set of panels according to claim 1, wherein the flexible tongue is arranged in the insertion groove in the second edge portion, said flexible tongue extending along said second edge portion; and the tongue groove is provided in, and extending along the first edge portion, wherein in a vertically locked state of the first and second edge portions the longitudinal end portion of the flexible tongue cooperates with the stop surface on the first edge portion.

13. The set of panels according to claim 1, wherein the horizontal locking device comprises a locking element arranged on a strip extending horizontally outwards from a lower portion of the first edge portion He and a locking groove provided in the second edge portion, the locking element and the locking groove being configured to cooperate to provide a horizontally locked state of the first and the second edge portions.

14. The set of panels according to claim 1, wherein the first and second edge portions are configured to be vertically unlocked by a relative vertical displacement of the first and second edge portions away from each other and/or by a repeated relative vertical displacement of the first and second edge portions away from and towards each other.

15. The set of panels according to claim 1, wherein there is a shelf, between and horizontally separating a joint seam and the tongue groove or the insertion groove the joint seam being a seam between the front side of the first panel and the front side of the second panel.

* * * * *